United States Patent [19]

Fujio et al.

[11] Patent Number: 5,037,278

[45] Date of Patent: Aug. 6, 1991

[54] SCROLL COMPRESSOR WITH HEAT INSULATING AND SOUNDPROOF COVER IN BOTTOM DISPOSED LOW PRESSURE CHAMBER

[75] Inventors: Katuharu Fujio; Michio Yamamura; Hiroshi Morokoshi, all of Shiga; Shuichi Yamamoto, Kyoto; Shigeru Muramatsu, Shiga, all of Japan

[73] Assignee: Matsushita Electric Industrial Co., Ltd., Osaka, Japan

[21] Appl. No.: 373,122

[22] Filed: Jun. 28, 1989

[30] Foreign Application Priority Data

Jun. 28, 1988 [JP] Japan ..... 63-159989
Jun. 28, 1988 [JP] Japan ..... 63-159995

[51] Int. Cl.[5] ..... F04C 18/04; F04C 29/02; F04C 29/04; F04C 29/06

[52] U.S. Cl. ..... 418/55.2; 418/55.6; 418/83; 418/97; 418/181; 418/DIG. 1

[58] Field of Search ..... 418/55 R, 55 A, 55 D, 418/55 E, 83, 97, 181, DIG. 1, 55.1, 55.2, 55.5, 55.6

[56] References Cited

U.S. PATENT DOCUMENTS

| | | | |
|---|---|---|---|
| 4,347,042 | 8/1982 | Holdsworth | 417/53 |
| 4,522,575 | 6/1985 | Tischer et al. | 418/55.5 |
| 4,811,471 | 3/1989 | Etemad et al. | 418/55 E |
| 4,842,499 | 6/1989 | Nishida et al. | 418/55.6 |
| 4,846,640 | 7/1989 | Nishida et al. | 418/55.6 |

FOREIGN PATENT DOCUMENTS

| | | | |
|---|---|---|---|
| 0213216 | 3/1987 | European Pat. Off. | 418/181 |
| 3731837 | 4/1988 | Fed. Rep. of Germany . | |
| 43-002518 | 1/1968 | Japan . | |
| 55-046046 | 3/1980 | Japan . | |
| 57-062990 | 4/1982 | Japan . | |
| 57-070984 | 5/1982 | Japan . | |
| 57-131896 | 8/1982 | Japan | 418/55 R |
| 57-206786 | 12/1982 | Japan | 418/55 R |
| 58-15787 | 1/1983 | Japan | 418/55 E |
| 59-068592 | 4/1984 | Japan . | |
| 59-79092 | 5/1984 | Japan | 418/55 A |
| 59-084378 | 6/1984 | Japan . | |
| 59-218323 | 12/1984 | Japan . | |
| 62-091686 | 4/1987 | Japan . | |
| 63-080089 | 4/1988 | Japan . | |
| 63-124890 | 5/1988 | Japan . | |
| 63-246484 | 10/1988 | Japan . | |
| 1-24190 | 1/1989 | Japan . | |
| 731000 | 4/1980 | U.S.S.R. | 418/181 |
| 2194290 | 3/1988 | United Kingdom . | |

*Primary Examiner*—John J. Vrablik
*Attorney, Agent, or Firm*—Panitch Schwartze Jacobs & Nadel

[57] ABSTRACT

The scroll gas compressor of the invention is so constructed that an enclosed container is partitioned by a fixed scroll member into a high pressure chamber and a low pressure chamber for gas-liquid separating intake refrigerant and storing it, the low pressure chamber being disposed at the lower portion and the high pressure chamber at the upper portion of enclosed container, the high pressure chamber disposing therein a drive unit related to a scroll compression mechanism and a lubricating oil sump, and the fixed scroll member serving also as part of the bottom of the lubricating oil sump, thereby providing that is small-sized, wide in an operational speed range, and superior in durability, and that prevents absorption of heat and noise propagation from the low pressure chamber serving as both the gas-liquid separation chamber and the reservoir of fluid, thereby improving the compression efficiency and lowering noise.

13 Claims, 14 Drawing Sheets

Fig. 3
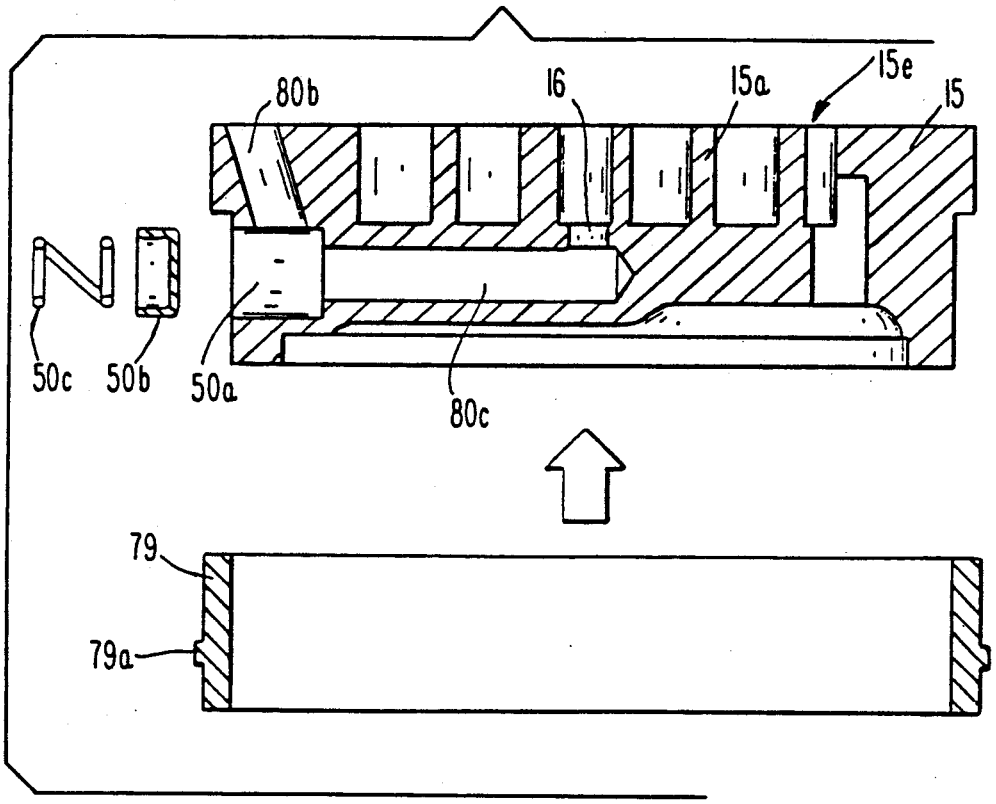
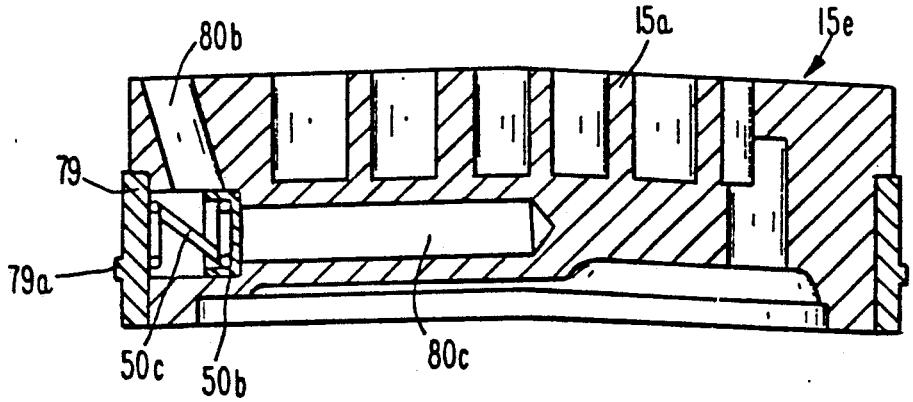
Fig. 4

SCROLL COMPRESSOR WITH HEAT INSULATING AND SOUNDPROOF COVER IN BOTTOM DISPOSED LOW PRESSURE CHAMBER

BACKGROUND OF THE INVENTION

1. Field of the Invention

The present invention relates to a scroll fluid compressor which partitions the interior of an enclosed container into a high pressure section and a low pressure section serving as an accumulator.

2. Description of the Prior Art

Scroll compressors have generally been known which are provided at the outer periphery with a suction chamber and at the center of a spiral with a discharge port so that fluid is taken-in and compressed at a spiral compression space symmetrical with respect to the discharge port, the compressed fluid flowing in one direction and compression torque less in variation than a reciprocation compressor or a rotary compressor, thereby extremely reducing vibrations or noises.

A usual refrigeration system, as shown in FIG. 17, constitutes a refrigeration cycle of a compressor 111, a condenser 112, an expansion valve 113 and an evaporator 114 sequentially connected, in which in order to restrain storage of intake refrigerant and compression of liquid refrigerant apt to occur in a compression chamber of compressor 111 to thereby improve durability of compressor, an accumulator 110 for gas-liquid separation and storage of refrigerant is provided between the suction side of compressor 111 and the evaporator 114, the accumulator 110 is mounted in the vicinity of the side surface of compressor 111, and heat insulation is applied between the accumulator 110 and the compressor 111, whereby intake gas refrigerant is heated following heating of the accumulator 110 so as to prevent the compression efficiency from lowering.

The accumulator 110, as shown in FIG. 18, is so designed that a baffle plate 103 is disposed at the upper end of a center pipe 104, so that the liquid refrigerant returning from the evaporator 114 is prevented from directly flowing into the upper opening of the center pipe 104 connected to the suction side of compressor 111, thus forming a bypass B through which the refrigerant passes (refer to Japanese Laid-Open Utility Model Publication No. 59-84378).

When such an accumulator 110 for gas-liquid separation and storage of refrigerant is mounted on the scroll refrigerant compressor for lessening vibrations and noises, a problem is created in that the intake liquid refrigerant strikes the inner wall or the like at the scroll refrigerant compressor to cause vibrations by the accumulator itself, thereby exciting the scroll refrigerant compressor, and that the refrigerant collision noise transmits to the body 101 that is small in thickness for weight reduction to thereby deteriorate low vibration and low noise characteristics of the scroll compressor.

Another problem is created in that the compressor and accumulator are separate in construction regardless of construction of the compressor so that the compressor and accessories thereof require a large space for disposing them.

To eliminate the above-mentioned problems, it is proposed that the compressor houses therein an accumulator unit for gas-liquid separation as disclosed in the Japanese Patent Publication No. 43-2518. However, this construction is disadvantageous in that the wall area forming the accumulator unit is large and the intake gas refrigerant passes through an electric motor unit, so that the intake gas refrigerant is heated which significantly lowers compression efficiency. Especially, when a large quantity of liquid refrigerant is returned to the compressor in the scroll compressor, liquid compression is apt to occur in the permanently enclosed space in the compression chamber that does not connect with both the suction chamber and the discharge chamber, and an excessive compression load causes damage in the compression chamber-constructing members or breakdown in the bearings, so that some means for reducing the compression load and preventing the liquid compression must be provided.

FIG. 19 shows another scroll compressor, in which an enclosed container 206 is partitioned therein from a scroll compression unit through a frame 209, a low pressure chamber **206*b* being formed above the frame 209 and a high pressure chamber 206*a* below the frame. The low pressure chamber 206*b* gas-liquid separates the refrigerant, and heat quantity transmitted from the high pressure chamber 206*a* through the enclosed container 206 is used to completely evaporate the intake refrigerant by being heated to a certain extent, after which the refrigerant is taken into the compression chamber through a suction pipe 210 provided at a fixed scroll member 202, thereby preventing the occurrence of liquid compression. After the compressed gas refrigerant is discharged to the high pressure chamber 206*a* through an outflow path 211, a lubricating oil is separated from the discharged gas refrigerant, an O-ring 214 provided between the frame 209 and the enclosed container 206 is used to seal between the low pressure chamber 206*b* and the high pressure chamber 206*a*, a heat insulating material 213 of Teflon mounted on the upper surface of the fixed scroll member 202 reduces heating to liquid refrigerant 219 at the low pressure chamber 206*b***, and the gas-liquid separation chamber is integral with the enclosed container, thereby expecting space saving, low noises and low vibrations at a time when the compressor is installed (refer to Japanese Laid-Open Patent Publication No. 57-70984).

A scroll compressor with a structure similar to the above-mentioned is also described in specification of the U.S. Pat. No. 4,522,575.

With the structure shown in FIG. 19, since the low pressure chamber **206*b* is disposed at the upper portion of the scroll compression unit, the liquid refrigerant 219 directly contacts at the outer periphery thereof with the enclosed container 206 at a high temperature and forming the high pressure chamber 206*a*, thereby creating the problem in that the outer periphery of liquid refrigerant 219 that is higher in density than gas refrigerant and that is superior in thermal conductivity and the intake gas refrigerant above the liquid refrigerant 219** are heated to lower the compression efficiency.

When the wall constituting the low pressure chamber **206*b* at the enclosed container 206 is larger in thickness, refrigerant noises caused by the intake gas refrigerant flowing into the low pressure chamber 206*b* to strike the inner wall thereof and the resonant noises of enclosed container 206, are not propagated to the exterior of the compressor, but a sectional area of the enclosed container 206 becomes large, thereby creating a problem in that a heat quantity at the high pressure chamber 206*a*** side is apt to be transferred to the liquid refrigerant and/or the intake gas refrigerant to thereby further lower the compression efficiency.

Conversely, when the wall of the low pressure chamber 206*b* is smaller in thickness, the refrigerant noise or the resonant noise of the enclosed container 206 are propagated to the exterior of the compressor, thereby creating a problem in that especially the low noise characteristics of the scroll compressor are deteriorated.

It is required to ensure a distance between the end of the motor and the oil level at a lubricating oil sump provided at the bottom of the high pressure chamber 206*a* in order to prevent an outflow of lubricating oil to the exterior of the compressor and/or a power loss caused by agitating the lubricating oil in the sump when a rotor of a motor disposed above the sump rotates at high speed. As the result, the high pressure chamber 206*a* is larger in height, thereby creating a problem in that the compressor is large-sized. Moreover, since the lubricating oil sump is at the bottom apart from the compression unit, during the stopping the compressor for a long time, the lubricating oil at a bearing slidable portion flows into the sump, thereby creating a problem in that, when the compressor restarts, the bearing slidable portion may seize.

In the construction that the fixed scroll 202 contacts at one side with the low pressure chamber 206*b* and at the other side with the compression chamber, as disclosed in FIG. 2*b* of Japanese Laid-Open Patent Publication No. 55-46046, pressure in the compression chamber swells the central portion of fixed scroll 202 toward the low pressure chamber 206*b*. As the result, an axial gap at the compression chamber is enlarged to increase a leakage amount of compressed gas refrigerant, thereby creating a problem in that the compression efficiency remarkably lowers.

To solve the above-mentioned problems, as disclosed in FIG. 4 of Japanese Laid-Open Patent Publication No. 55-46046, a construction has been proposed in which a back pressure chamber is formed at the rear of the fixed scroll, fluid pressure of the back pressure chamber is applied to the fixed scroll, so that the compression chamber pressure restrains the swollen central portion of the fixed scroll, thereby preventing lowering of compression efficiency while keeping a proper axial gap at the compression chamber.

However, it is required for the above-mentioned construction of Japanese Laid-Open Patent Publication No. 55-46046 to provide a particular back pressure chamber at the rear side of fixed scroll, thereby creating a problem in that the member of parts increases to raise the manufacturing cost, the space for installing the low pressure chamber is reduced, and the gas-liquid separation efficiency of the intake refrigerant deteriorates. Hence, a scroll gas compressor has been desired which is small-sized, high in compression efficiency, superior in low vibrations, low noise characteristics, durability, and processes a wide range of operating speeds.

SUMMARY OF THE INVENTION

The scroll gas compressor of this invention, which overcomes the above-discussed and numerous other disadvantages and deficiencies of the prior art, comprises an enclosed container and a scroll compression mechanism that is housed in said container, said container being partitioned therein by a fixed scroll member into a high pressure chamber and a low pressure chamber in which intake fluid is gas-liquid-separated and stored, said low pressure chamber being disposed at the lower portion of said container and said high pressure chamber being disposed at the upper portion of said container, at said high pressure chamber being disposed a driving mechanism related to said scroll compression mechanism and a lubricating oil sump, and with said fixed scroll member serving as part of the bottom surface of said lubricating oil sump, wherein a whirling scroll wrap on a wrap support disc of part of a whirling scroll is swingably and rotatably engaged with respect to a spiral fixed scroll wrap formed at one surface of a panelboard of part of said fixed scroll member, a spiral compression space is formed between both said scrolls, a discharge port is provided at the central portion of said fixed scroll wrap or said whirling scroll wrap, a suction chamber is provided outside of said fixed scroll wrap, said compression space is partitioned into a plurality of compression chambers continuously traveling from the suction side to the discharge side, and a rotation blocking member for said whirling scroll is disposed between said whirling scroll and a fixed member to form said scroll compression mechanism for whirling said whirling scroll in order to compress fluid.

In a preferred embodiment, a major part of an inner wall member forming said low pressure chamber is covered by a member of low natural frequency, said member being made of a low specific gravity and soft material and having both heat insulating and sound proof characteristics.

In a preferred embodiment, the low pressure chamber has a suction passage through which said fluid is taken into said compression chamber from the upper potion of said low pressure chamber.

In a preferred embodiment, the member covering the inner wall of said low pressure chamber partitions the inside thereof into a gas-liquid separation space or a storage space for said intake fluid and a passage for said intake gas.

In a preferred embodiment, the fixed scroll member comprises a fixed scroll forming together with said whirling scroll said compression chamber and a liner, said liner being press-fitted and fixed to the outer peripheral portion of said panelboard at the reverse whirling scroll side of said fixed scroll and formed in a cylinder with a thin wall, the material of which is the same as that of said container, and the outer peripheral portion of said liner and said container being welded to be sealed and fixed with each other.

In a preferred embodiment, the fixed scroll is comprised of a substance that is larger in thermal expansion coefficient than those of said liner and said container.

In a preferred embodiment, a diameter of the outer peripheral portion at the low pressure chamber side of said fixed scroll is made smaller than that at the high pressure side thereof, so that said liner is press-fitted into the outer peripheral portion at the low pressure chamber side.

In a preferred embodiment, the high pressure chamber is disposed at the upper portion of said container and said low pressure chamber is disposed at the lower portion of said container.

In a preferred embodiment, the body frame member supporting a drive shaft of said scroll compression mechanism and fixed to said fixed scroll member is fixed to said container.

In a preferred embodiment, the body frame member comprises at the outermost periphery thereof said liner of a cylinder with a thin wall, the material of which is the same as that of said container, the outer periphery of said liner being welded to be fixed to said enclosed container.

In a preferred embodiment, the lubricating oil sump connects with said compression chamber through an oil supply passage having a restriction passage, part of said oil supply passage having a route positioned higher than the oil level at said lubricating oil sump.

According to this invention, the lubricating oil, which is compressed together with the intake gas gas-liquid-separated at the low pressure chamber for preventing liquid compression and discharged into the high compression chamber, is separated from the discharge gas, stored keeping the oil level in the bottom of lubricating oil in the vicinity of the fixed scroll member without being subjected to a flow rate of discharged gas and/or diffusion due to the rotor at the driving unit, and fed to the bearing slidable portion and the compression chamber, thereby preventing wearing at the slidable portion, reducing friction, and sealing the gap at the compression chamber by means of an oil film action.

Moreover, heat transfer from the enclosed container forming the high pressure chamber at the compressor to the members covering the inner wall of the low pressure chamber is reduced and heating of the intake liquid stored at the bottom of low pressure chamber is reduced. Besides, both the gas-liquid separation function and the intake liquid-storing function are incorporated into the compressor, so that compression coefficient lowering can be reduced.

Moreover, sound generated when a gas-liquid mixture fluid flows into the low pressure chamber and collides with the inner wall thereof, is lessened and propagation of sound to the exterior of the compressor is reduced.

Furthermore, the panelboard of the fixed scroll is warped toward the compression chamber by a contracting force of the enclosed container when welded with the outer periphery of the liner thereof and a press-fit tightening force of the liner, thereby reducing in advance the axial gap at the central portion of the compression chamber when assembled. In such state, the scroll fluid compressor is operated so that the central portion of the fixed scroll is pushed back toward the low pressure chamber by differential pressure between the compression pressure at the compression chamber and the intake pressure at the low pressure chamber, whereby the axial gap at the outer periphery and also the central portion of the compression chamber are made about proper at the axial gap at the outer periphery to keep a normal compression chamber gap and to continue effective compression operation.

Even when the compression mechanism rises to a high temperature and a temperature difference between the fixed scroll member and the enclosed container in contact with the outside atmosphere is enlarged during the high speed operation of the compressor, a slip occurs between the fixed scroll at the fixed scroll members and the liner so as to prevent generation of stress following thermal expansion of the compression mechanism and the enclosed container, and to support the compression mechanism by the enclosed container at two portions of the fixed scroll member and main body frame, thereby preventing deflection of the compression mechanism.

Moreover, when the lubricating oil in the sump provided above the compression chamber flows by its weight into the compression chamber during the stop of compressor, the lubricating oil is blocked by the portion of an oil supply passage positioned higher than the oil level at the lubricating oil sump, so that no lubricating oil flows into the compression chamber, thereby preventing liquid compression when the compressor restarts.

Thus, the invention described herein makes possible the objectives of (1) providing a scroll gas compressor that is small-sized, wide in an operation speed range, and superior in durability;

(2) providing a scroll gas compressor that prevents absorption of heat and noise propagation from the low pressure chamber serving as both the gas-liquid separation chamber and the reservoir of fluid, thereby improving the compression efficiency and lowering noise;

(3) providing a scroll gas compressor that restrains the fixed scroll member from being distorted by the compression chamber pressure toward the low pressure chamber so as to enlarge the axial gap at the compression chamber, and prevents the compression efficiency from lowering;

(4) providing a scroll gas compressor in which, even when a remarkable temperature difference is created between the compression mechanism and the enclosed container, useless stress is not generated, thereby rigidly fixing the compression mechanism to the enclosed container, thereby reducing vibrations and noises; and (5) providing a scroll gas compressor that restrains the lubricating oil in the sump provided above the compression chamber from flowing by its weight therein during the stop of the compressor, and prevents the creation of liquid compression when the compressor restarts.

Other objectives and advantages of the invention will become apparent from the following description of embodiments.

BRIEF DESCRIPTION OF THE DRAWINGS

This invention may be better understood and its numerous objects and advantages will become apparent to those skilled in the art by reference to the accompanying drawings as follows:

FIG. 3 is a decomposed sectional view showing the fixed scroll member and the check valve unit of the compressor.

FIG. 4 is a front sectional view showing the magnifying deformation of the fixed scroll member after assembly.

DESCRIPTION OF THE PREFERRED EMBODIMENTS

Figure 1:
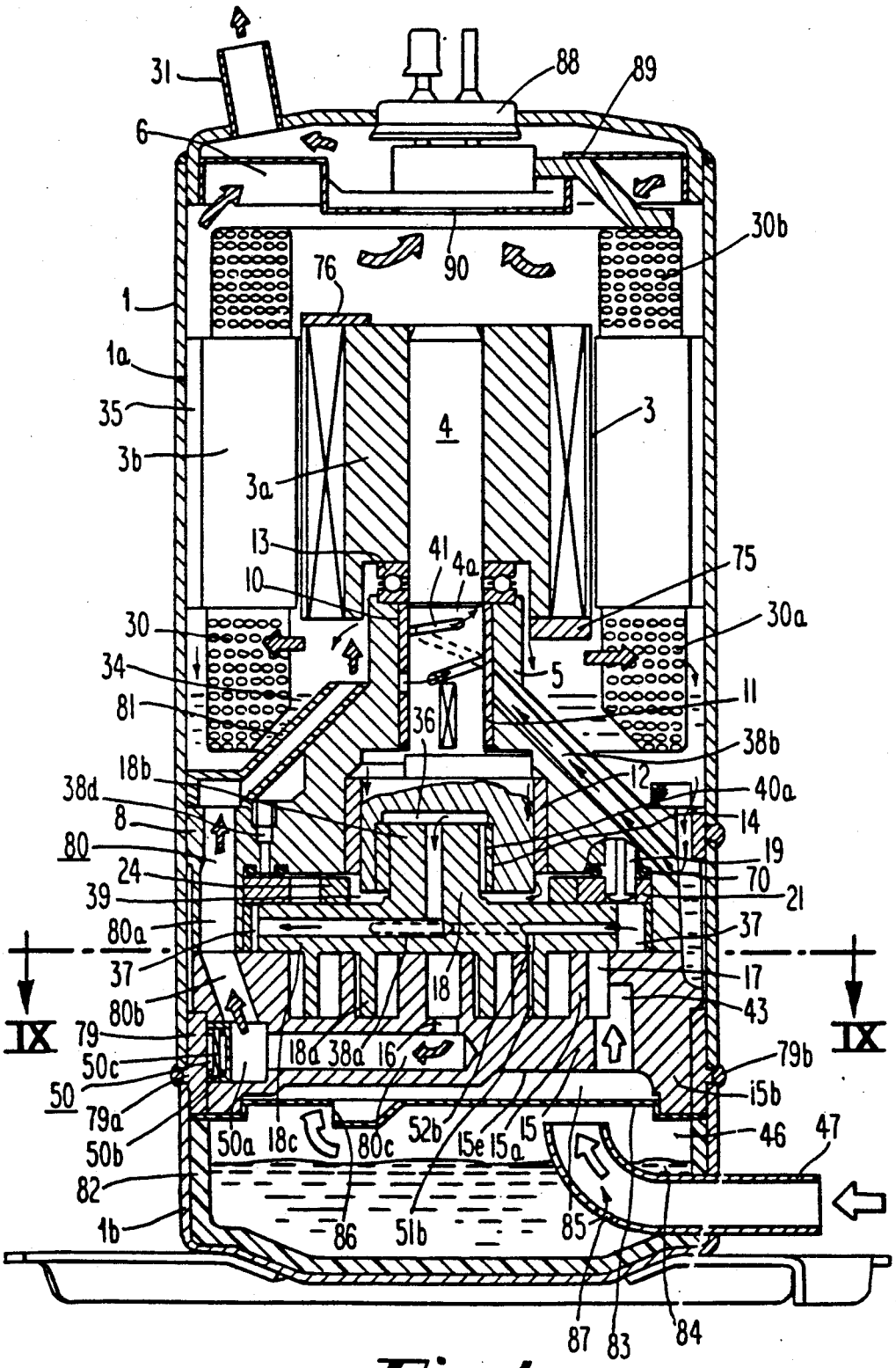
FIG. 1 is a front sectional view showing a scroll refrigerant compressor of this invention.

FIG. 1 shows a scroll refrigerant compressor of this invention, in which an enclosed casing of iron is partitioned therein into an upper motor chamber 6 and a lower accumulator chamber 46 by a fixed scroll member 15*e* engageable with a whirling scroll 18 to form a compression chamber. The motor chamber 6 is under high pressure and has a motor 3 at the upper portion and a compression unit at the lower portion. A body frame 5 at the compression unit supports a drive shaft 4 fixed to a rotor 3*a* of the motor 3, is made from aluminum alloy superior in heat transfer characteristics mainly aiming at light weight and heat divergence from the bearing, and is fixed by bolts to the fixed scroll member 15*e*. A liner 8 of iron superior in weldability is shrink-fitted onto the outer periphery of the fixed scroll member 15*e* and contacts at the entire outer periphery with the inner surface of the enclosed casing 1 and partially welded thereto.

A stator 3*b* of the motor 3 fixedly contacts with the inner surface of the enclosed casing 1.

The drive shaft 4 is supported by an upper bearing 11 at the upper end of the frame 5, a main bearing 12 at the central portion thereof, and a thrust ball bearing 13 provided between the upper end face of the body frame 5 and the lower end face of the rotor 3*a* of the motor 3. Also, at the lower end of the frame 5 is provided an eccentric bearing 14 eccentric from the drive shaft 4.

The fixed scroll member 15*e*, as shown in FIG. 3, comprises a partition liner 79 of iron superior in weldability and shrink-fitted onto the outer periphery of the fixed scroll 15 of aluminum alloy.

The fixed scroll 15 comprises a spiral fixed scroll wrap 15*a* and a panelboard 15*b*. At the center of the panelboard 15*b* is provided a discharge port 16 open at the spiral beginning of the fixed scroll wrap 15*a* and connecting with a discharge passage 80 that connects with the motor chamber 6, a suction chamber 17 being provided at the outer periphery of fixed scroll wrap 15*a*.

Also, the fixed scroll 15, as shown in FIG. 4, is built-in in such a manner that the center thereof is warped toward the fixed scroll wrap 15*a* by a tightening force for shrink-fitting the partition liner 79 and/or a contracting force of the partition liner 79 and the enclosed casing 1 when they are welded.

The whirling scroll 18 of aluminum alloy comprises a whirling scroll wrap 18*a* engageable with the fixed scroll wrap 15*a* to form the compression chamber, a pivot 18*b* straight supported to the eccentric bearing 14 of the drive shaft 4, and a wrap support disc 18*c* subjected at the surface to a surface hardening treatment. The whirling scroll 18 is disposed surrounded by the fixed scroll 15, body frame 5 and drive shaft 4, and forms with the fixed scroll member 15*e* the compression chamber.

As shown in FIG. 4, since the central portion of fixed scroll 15 is warped, the axial gap at the compression chamber is restricted at the center.

The discharge passage 80 comprises a discharge gas guide 81 mounted to the body frame 5, a gas passage 80*a* provided at the body frame 5, and gas passages 80*b* and 80*c* provided at the fixed scroll 15, a check valve unit 50 being provided on the way of passage between the gas passage 80*c* connecting with the discharge port 16 and extending horizontally and the gas passage 80*b* extending vertically.

The check valve unit 50 comprises a check valve bore 50*a*, a valve body 50*b* and a spring 50*c* for biasing the valve body 50*b*. The check valve bore 50*a* is horizontally cylindrical and larger in diameter than the gas passage 80*c* and open at the outer periphery of the fixed scroll 15. The gas passage 80*b* is open at the side of bore 50*a* and smaller at the open end than the external size of either valve body 50*b* or spring 50*c*.

The valve body 50*b* is of size enough to be movable toward the connection of gas passage 80*c* and check valve bore 50*a*.

The partition liner 79, as shown in FIGS. 1 to 4, is shrink-fitted onto the smaller diameter outer periphery below the shoulder at the fixed scroll 15, the shrink-fitted surface being sealed, and the open end of the check valve bore 50*a* being enclosed.

The outer periphery of the partition liner 79 and a ridge 79*a* projecting from the entire outer periphery of the same abut against an upper enclosed casing 1*a* and a lower enclosed casing 1*b*, the ridge 79*a*, upper enclosed casing 1*a* and lower enclosed casing 1*b* being sealing-welded by a single welding bead 79*b*.

The accumulator chamber 46 connecting with the evaporator side of the refrigeration cycle is composed of the lower enclosed casing 1*b* and the fixed scroll member 15*e*, a heat insulating cover 82 of resins being mounted inside of the lower enclosed casing 1*b*.

A baffle 83 of resins is interposed between the fixed scroll member 15*e* and the heat insulating cover 82 so as to partition the accumulator chamber 46 into a lower gas-liquid separation chamber 84 and an upper suction passage 85.

A suction pipe 47, which perforates the side walls of both the lower enclosed casing 1*b* and the heat insulating cover 82 and is provided below the baffle 83, is open at its termination and opposite to the baffle 83 and positioned apart from a suction guide bore 86 provided at the baffle 83 and connects with the gas-liquid separation chamber 84 and the suction passage 85.

A small diameter oil bore 87 is provided on the way of the suction pipe 47, through which liquid refrigerant or lubricating oil staying at the bottom of gas-liquid separation chamber 84 reflows little by little into the suction pipe 47.

The vertical suction bore 43 provided at the fixed scroll 15 connects with the suction chamber 17 and suction passage 85.

A spacer 21 is provided between a thrust bearing 20 movable axially only by being restricted by a cotter pin type parallel pin 19 fixed to the body frame 5 and the panelboard 15*b* at the fixed scroll 15 and is larger in axial length by about 0.015 to 0.02 mm than the thickness of the wrap support disc 18c for improving the sealing efficiency at the sliding surface by an oil film.

An eccentric bearing space 36 formed between the bottom of the eccentric bearing 14 for the drive shaft 4 and the shaft of pivot 18b at the whirling scroll 18 connects with an outer periphery space 37 at the wrap support disc 18c through an oil bore 38a provided at the pivot 18b and the wrap support disc 18c.

Figure 2:
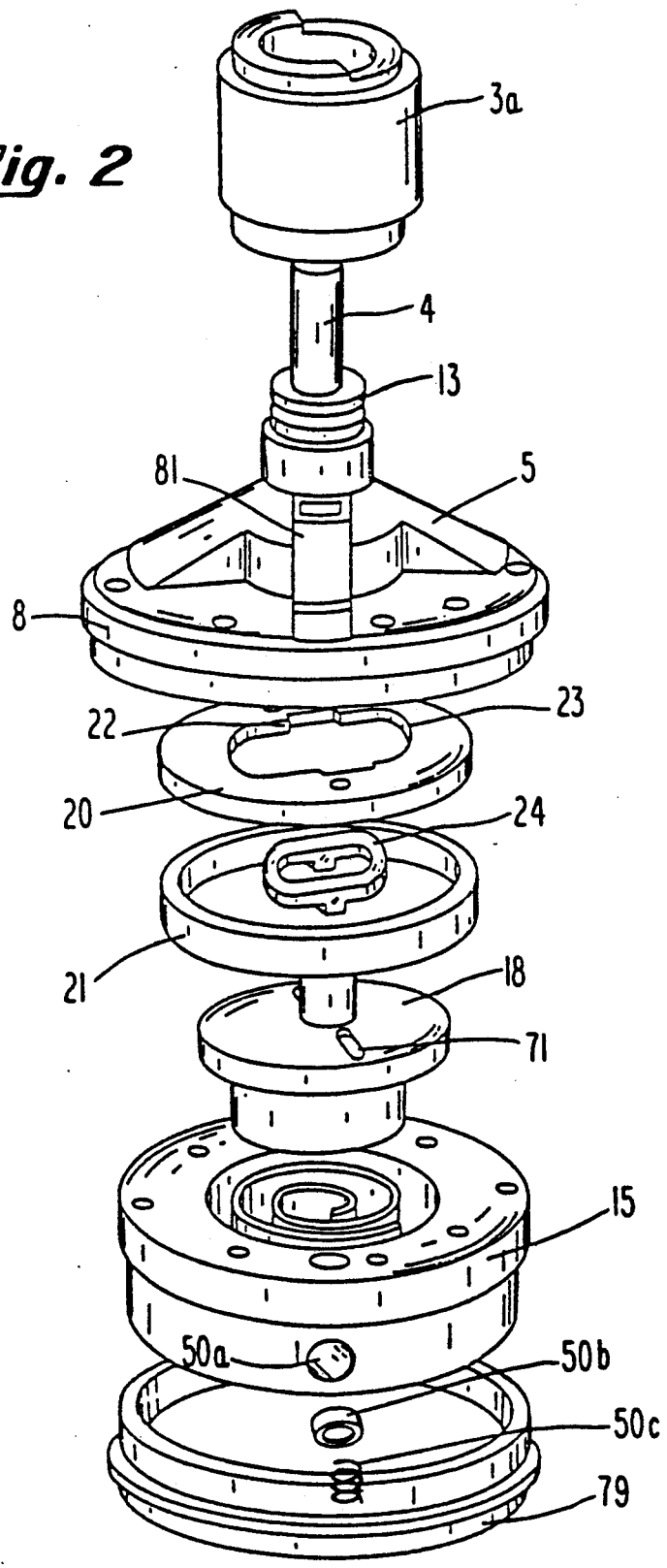
FIG. 2 is a decomposed view showing the principal part of the compressor shown in FIG. 1.
Figure 8:
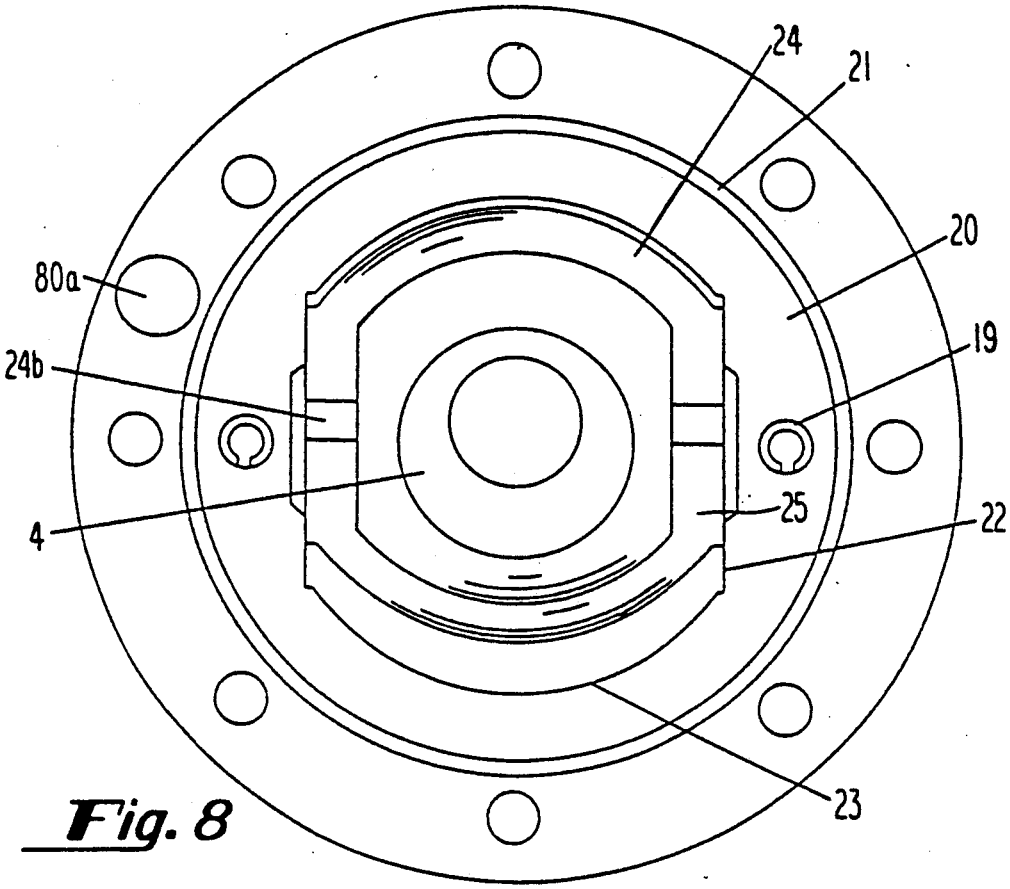
FIG. 8 is an upper plan view showing the Oldham mechanism unit in FIG. 7.
Figure 7:
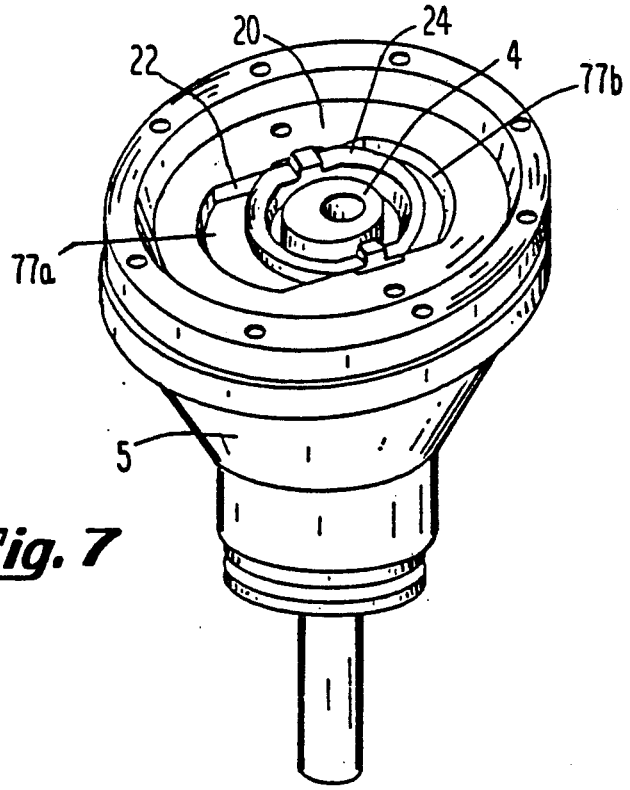
FIG. 7 is a perspective view showing the Oldham mechanism unit of the compressor.

The thrust bearing 20 is made of sintered alloy and, as shown in FIGS. 2, 7 and 8, is perforated with a precise bore comprising two parallel, straight portions 22 at the central portion and two portions 23 in a circular arc in continuation of the straight portions 22, respectively.

A rotation blocking member (hereinafter referred to as the Oldham's ring) 24 is made of light alloy or reinforced resin materials suitable for sintering molding or an injection molding method, has oil-containing characteristics, and, as shown in FIGS. 2, 6, 7 and 8, comprises a thin annular plate 24a with both parallel surfaces and a pair of parallel key portions 24b provided on one surface of the plate 24a. The outer periphery of annular plate 24a comprises two parallel straight portions 25 and two portions 26 in a circular arc in continuation thereof, respectively. Each straight portion 25, as shown in FIGS. 7 and 8, engages through a fine gap with each straight portion 22 at the thrust bearing 20 so as to be slidable. The side surface 24c of each parallel key portion 24b is perpendicular to the central portion of straight portion 25, and, as shown in FIG. 2, engages through a fine gap with one of a pair of keyways 71 provided at the wrap support disc 18c at the whirling scroll 18 so as to be slidable. The inner periphery of the annular plate 24a is like the outer periphery. A recess 24d provided at the root of each key portion 24b serves also as a passage for lubricating oil. A recess 24e provided at each circular arc portion 26 is a passage for the same, as well.

Figure 5:
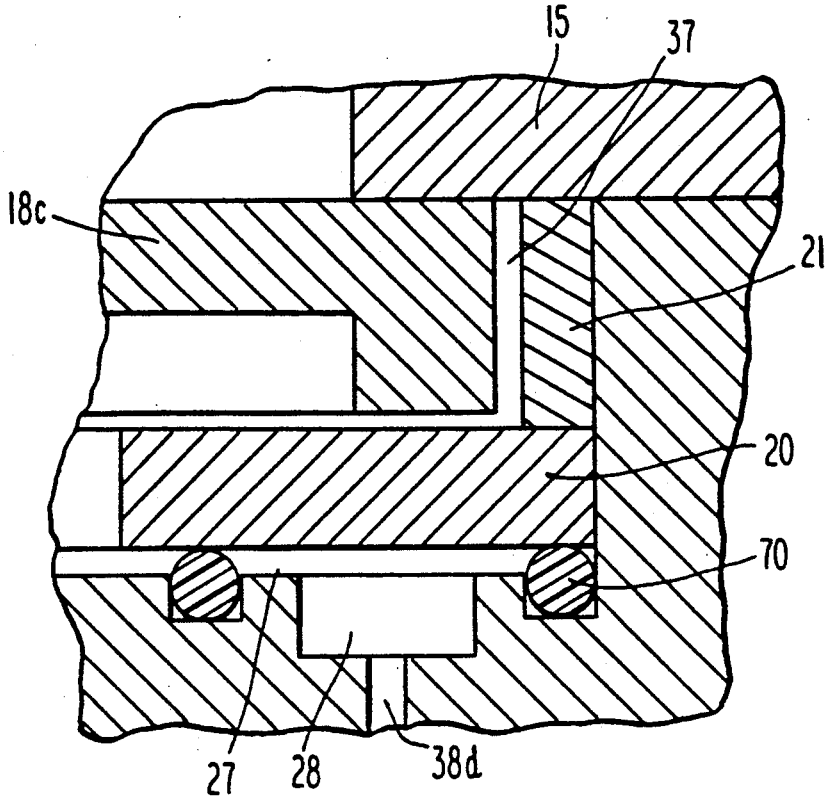
FIG. 5 is a front sectional view showing a part of the thrust bearing of the compressor.
Figure 6:
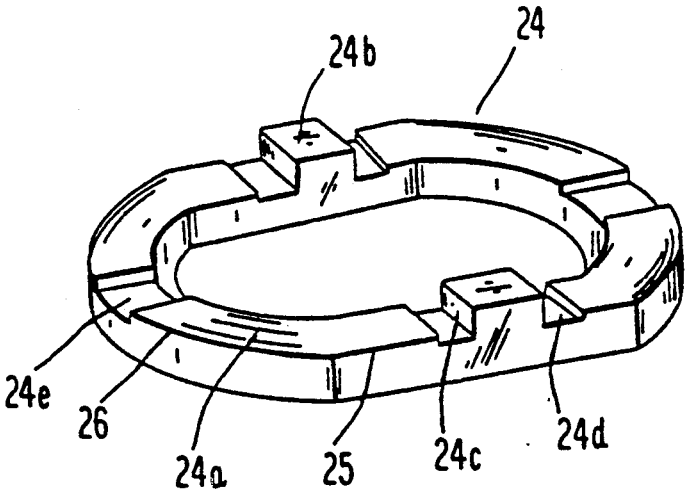
FIG. 6 is a perspective view showing the Oldham's ring of the compressor.

As shown in FIGS. 1 and 5, between the body frame 5 and the thrust bearing 20 is provided a release gap 27 of about 0.1 mm, an annular groove 28 opposite thereto is provided at the body frame 5, and a seal ring 70 encircling the annular groove 28 is interposed between the body frame 5 and the thrust bearing 20.

A discharge pipe 31 is mounted to the outer peripheral portion of an upper end wall of the upper enclosed casing 1a, and a glass terminal 88 for connecting the motor 3 to a power source is provided at the center of the upper end wall.

A thin oil separator 89 mounted to the upper enclosed casing 1a partitions the area including the discharge pipe 31 and the glass terminal 88 and the area including the motor 3 and is provided at the center with a through bore 90.

An oil sump 34 at the discharge chamber below the motor chamber 6 is so deep that the bottom thereof reaches the fixed scroll member 15e that is below the body frame 5, and connects with the upper portion of the motor chamber 6 through a refrigeration passage 35 provided by cutting part of the outer periphery of stator 3b of the motor 3. The oil sump 34 at discharge chamber also connects with the annular groove 28 through an oil bore 38d provided at the body frame 5. It also connects with a back pressure chamber 39 at the whirling scroll 18 at which the Oldham's ring 24 is disposed, through an oil bore 38b higher in part than the oil level at the sump 34 and a fine gap at the sliding portion of lower bearing 11 and an oil groove (not shown) at the sliding portion of main bearing 12. It also connects with the eccentric bearing space 36 through an oil groove 40a provided at the eccentric bearing 14.

The oil bore 38b provided in the body frame 5 also connects with a spiral oil groove 41 provided at the surface of the lower bearing 4a corresponding to the upper bearing 11 for the drive shaft 4. The spiral oil groove 41 is wound so as to cause a screw pumping operation utilizing the viscosity of lubricating oil when the drive shaft 4 normally rotates, the end of groove 41 being formed half-way up on the upper bearing 4a.

Rotational unbalance that is caused by weight of the eccentric wall portion at the lower end of the drive shaft 4, a quantity of wall eccentricity and weight of the whirling scroll 18, is eliminated by balance weights 75 and 76 mounted to the upper and lower ends of the rotor 3a.

Figure 10:
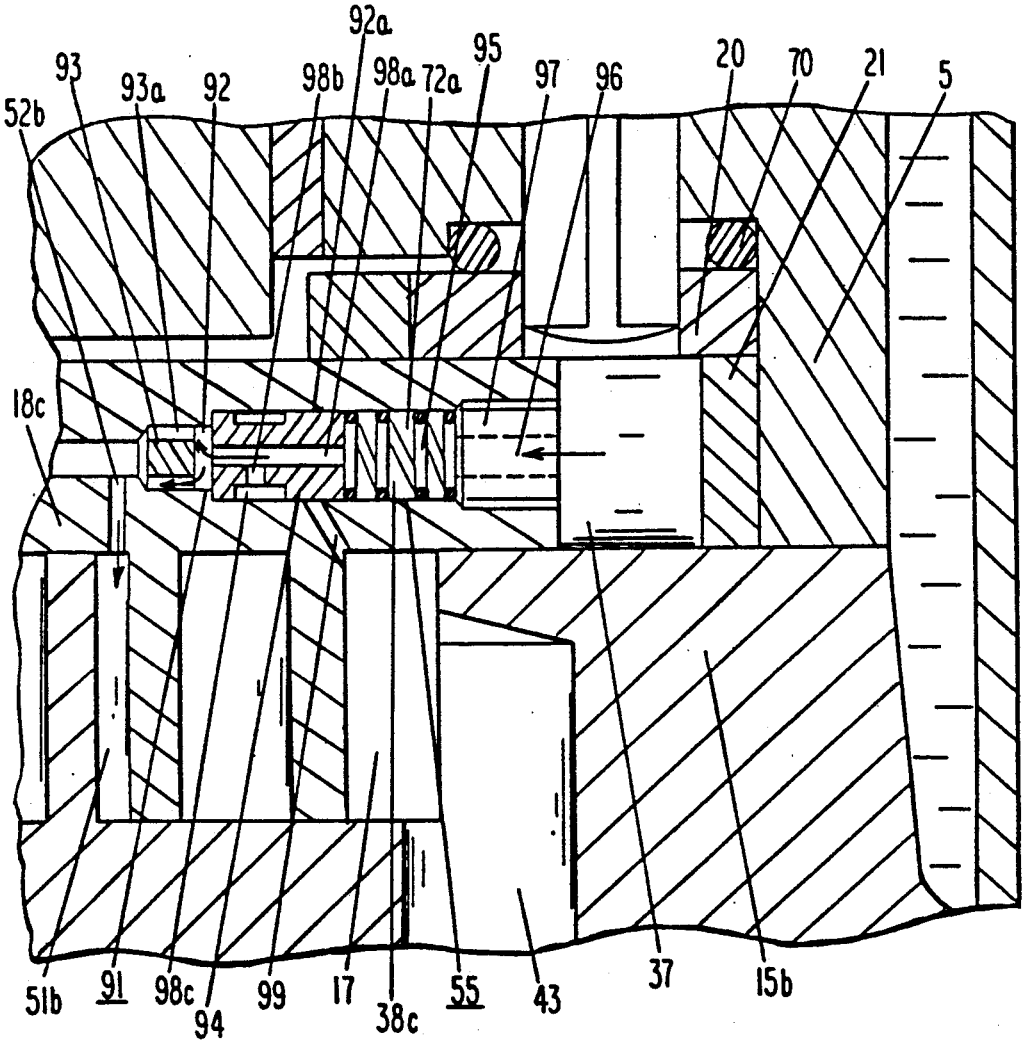
FIGS. 10 and 11 are front sectional views showing an enlarged mounting portion for an oil supply passage control valve in FIG. 1.
Figure 12:
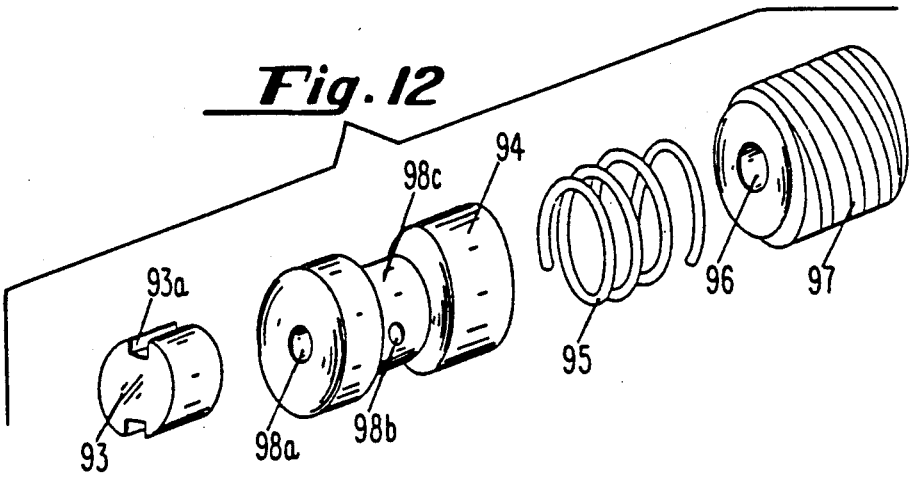
FIG. 12 is a perspective view showing parts constituting the oil supply passage control valve in FIG. 11.
Figure 11:
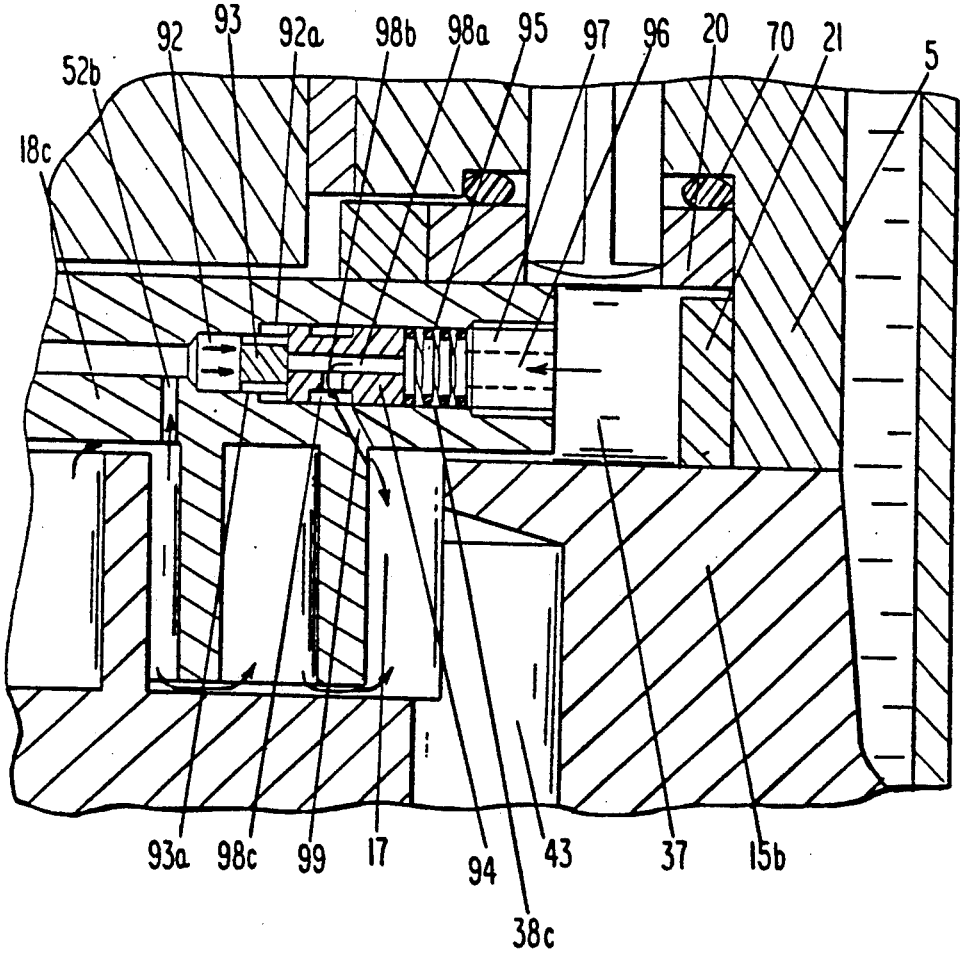

A second compression chamber 51 and the outer peripheral space 37, both of which do not connect with the suction chamber 17 and the discharge port 16 open at the second compression chamber 51, but connects with an injection passage 55 that comprises a smaller diameter injection bore 52 provided at the wrap support disc 18c of the whirling scroll 18 and an oil bore 38c. At the oil bore 38c is mounted an oil supply passage control valve 91 switching the oil supply passage thereof corresponding to the whirling speed of whirling scroll 18 and provided with a check valve function as shown in FIGS. 10 through 12.

The check valve 91 comprises a valve body 93 mounted to a stepped smaller diameter cylindrical bore 92 at the oil bore 38c, a plunger 94 mounted to a larger diameter cylindrical bore 92a at the oil bore 38c, a coil spring 95 for biasing the plunger 94, and a set screw 97 for stopping movement of the coil spring 95. The set screw 97 is provided at the center with an oil passage 96.

The valve body 93 that is made of Teflon or ceramics of light specific gravity is provided at the outer periphery with longitudinal extension through grooves 93a so as to be smoothly reciprocable in the smaller diameter bore 92. The plunger 94 that is made of a material, such as brass, of large specific gravity is provided at the central portion with a passage 98a, and the outer peripheral portion with a circumferential groove 98c and a passage 98b connecting with the passage 98a and circumferential groove 98c.

The coil spring 95 is made of a material which has shape memory characteristics such that the spring contracts when its temperature exceeds a set degree (for example, 130° C.) and expands when its temperature lowers.

At the wrap support disc 18c of the whirling scroll 18 is provided a smaller diameter bypass bore 99 connecting with the suction chamber 17 and the larger diameter bore 92a. The bypass bore 99 is open or enclosed by the stationary position of plunger 94.

Figure 13:
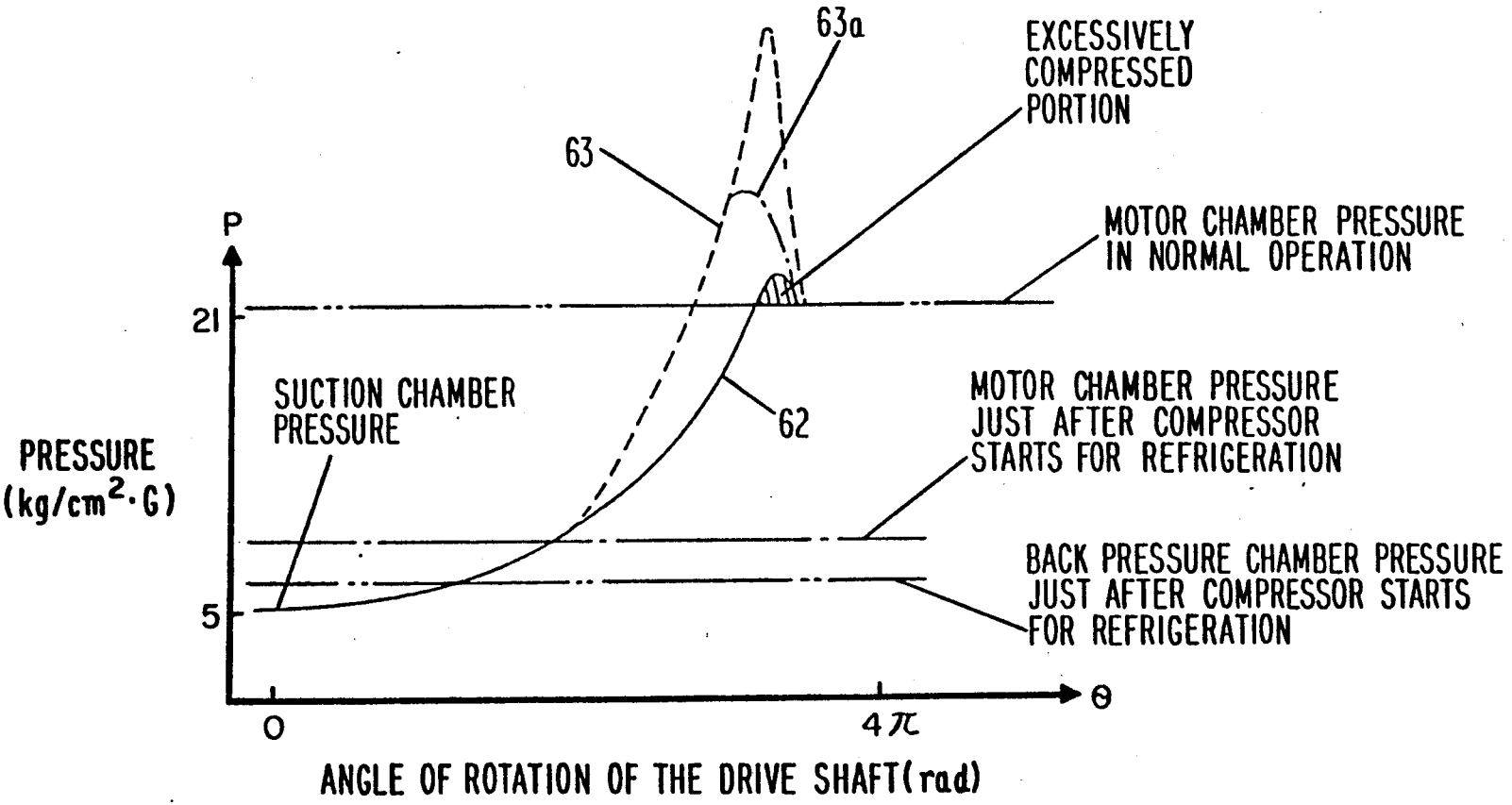
FIG. 13 is a graph of characteristic curves showing the pressure variation of gas refrigerant from a suction process to a discharge process at the compressor.

FIG. 13 shows the characteristic curves of pressure variation of gas refrigerant from a suction process to a discharge process at the above-mentioned scroll compressor, wherein the axis of abscissa represents a rotation angle of the drive shaft 4 and the axis of ordinate a refrigerant pressure so as to represent a pressure variation of gas refrigerant in the suction, compression and discharge processes. The solid line 62 shows a pressure variation during the operation under normal pressure, and the dotted line 63 shows a pressure variation with abnormal pressure rises.

Figure 9:
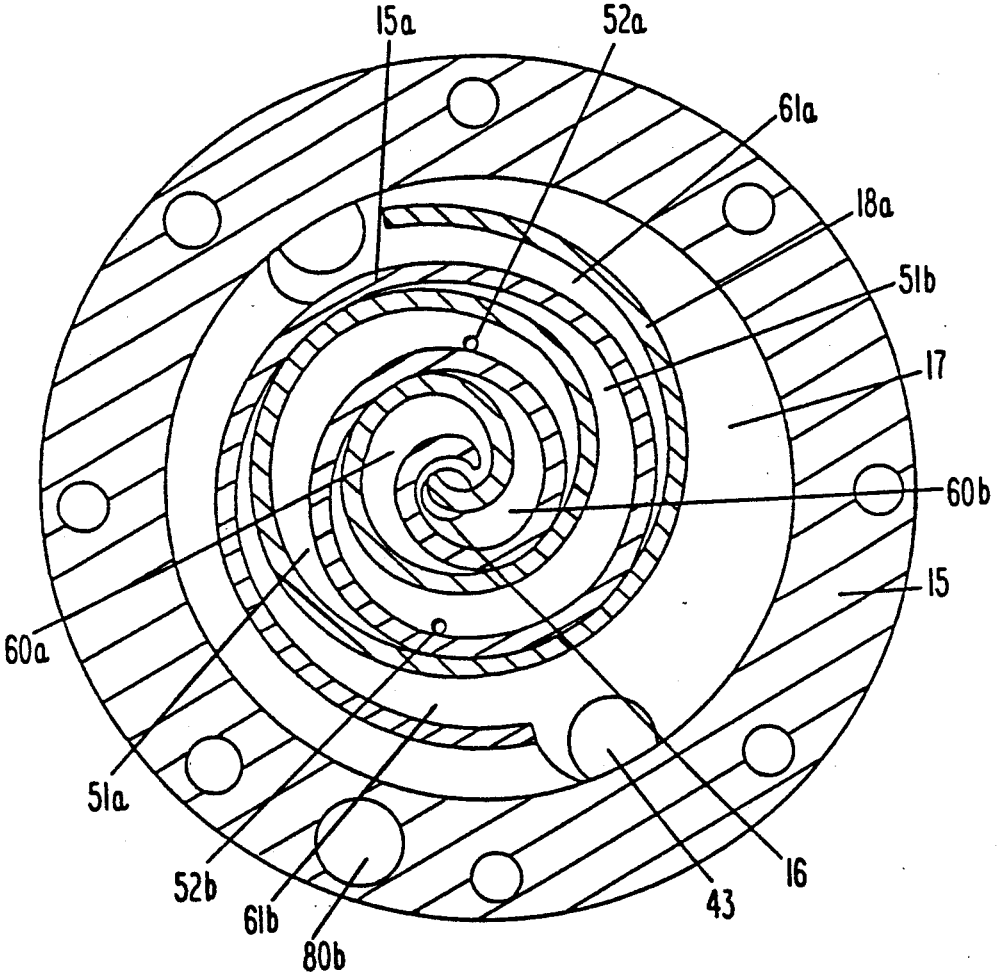
FIG. 9 is a cross-sectional view taken along the line IX—IX in FIG. 1.
Figure 14:
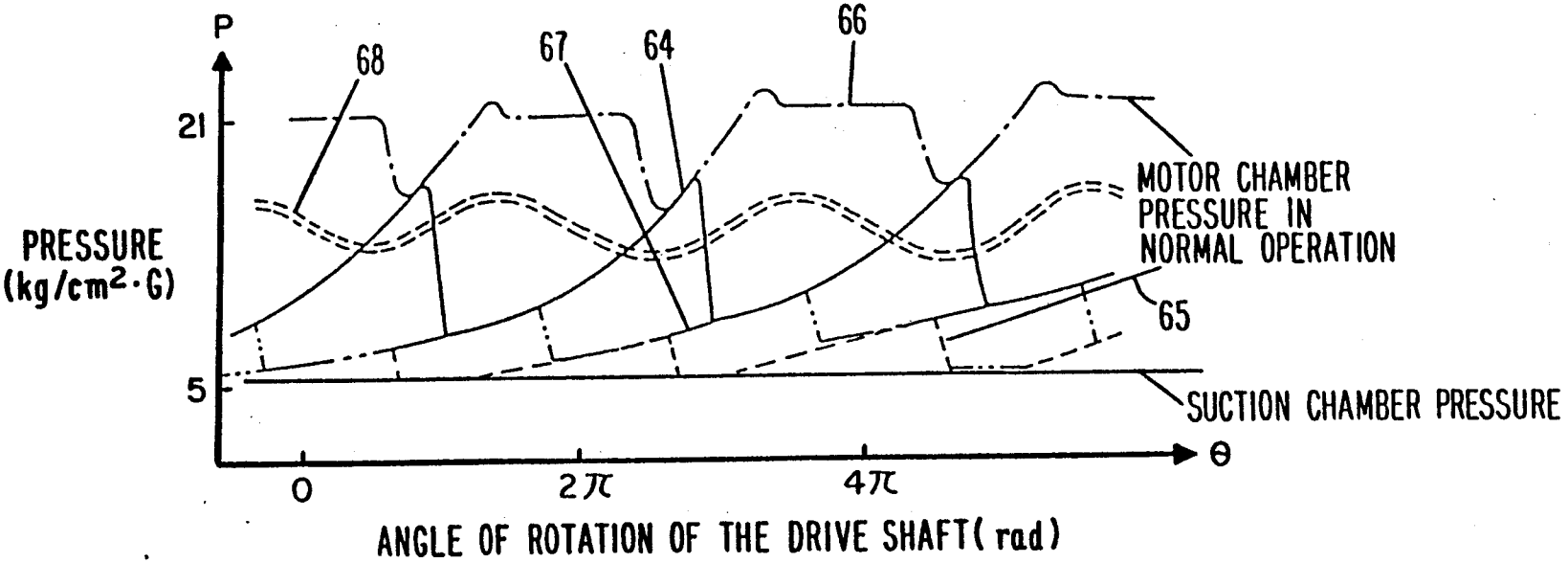
FIG. 14 is a graph of characteristic curves showing the pressure variation at a fixed point at each compression chamber of the compressor.

FIG. 14 shows the characteristic curves of pressure variation at a fixed point at each compression chamber, wherein the axis of abscissa shows a rotation angle of the drive shaft 4 and the axis of ordinate the refrigerant pressure. The solid line 64 shows a pressure variation at the open positions of the injection bores 52*a* and 52*b* at the second compression chambers 51*a* and 51*b* not connecting with the discharge chamber 2 and suction chamber 17, and the dotted line 65 shows a pressure variation at the fixed points of the first compression chambers 61*a* and 61*b* (refer to FIG. 9) connecting with the suction chamber 17, the one-dot chain line 66 shows a pressure variation at the fixed points of the third compression chambers 60*a* and 60*b* connecting with the discharge chamber 2, the two-dot chain line 67 shows a pressure variation at the fixed points between the first compression chambers 61*a* and 61*b* and the second compression chambers 51*a* and 51*b*, and the double-chain line 68 shows a pressure variation in the back pressure chamber 39.

Figure 15:
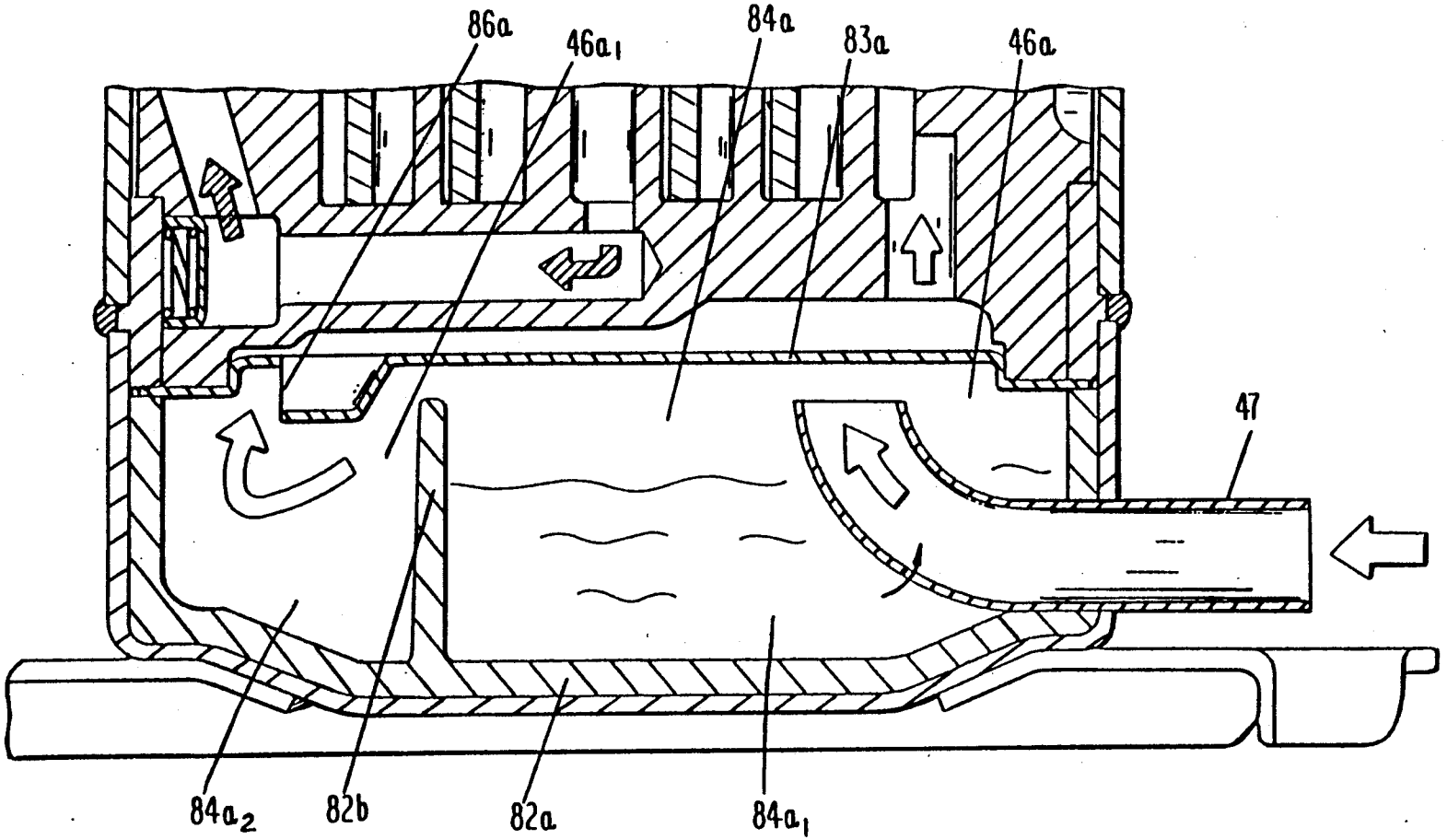
FIGS. 15 and 16, respectively, are front sectional views showing the accumulator chamber portions of second and third examples of the scroll refrigerant compressor of the invention.
Figure 16:
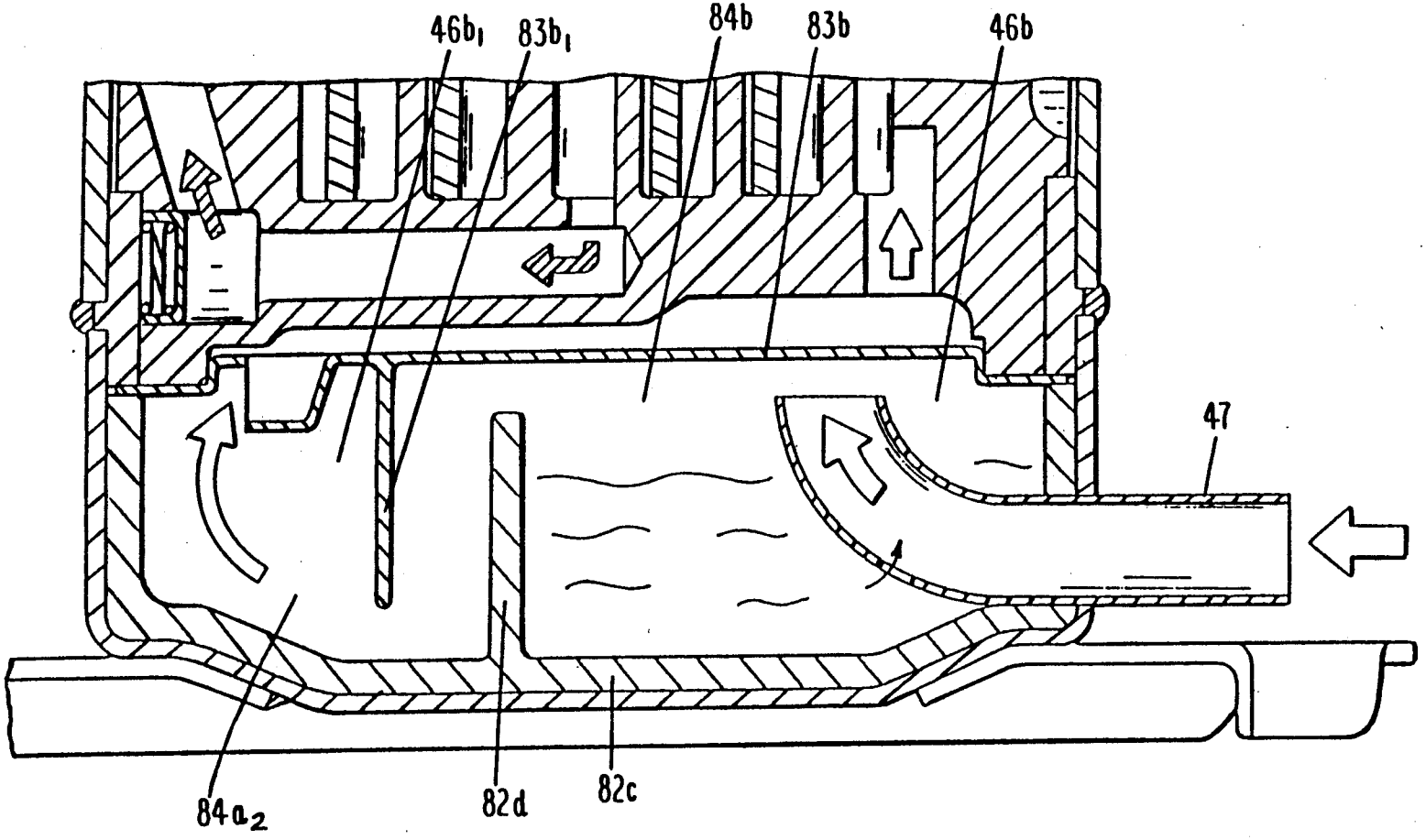
Figure 17:
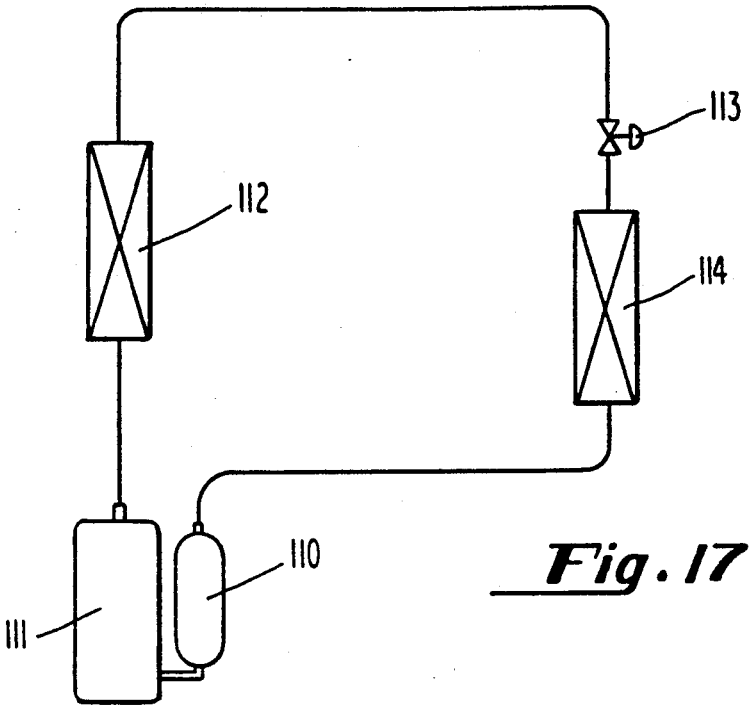
FIG. 17 is a connection diagram showing an apparatus constituting a usual refrigeration cycle.
Figure 18:
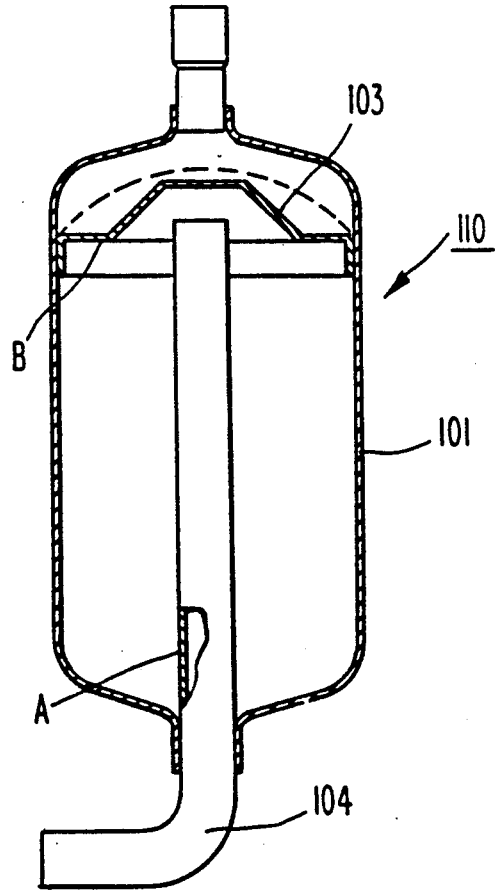
FIG. 18 is a front sectional view showing the accumulator connected to the compressor in FIG. 17.
Figure 19:
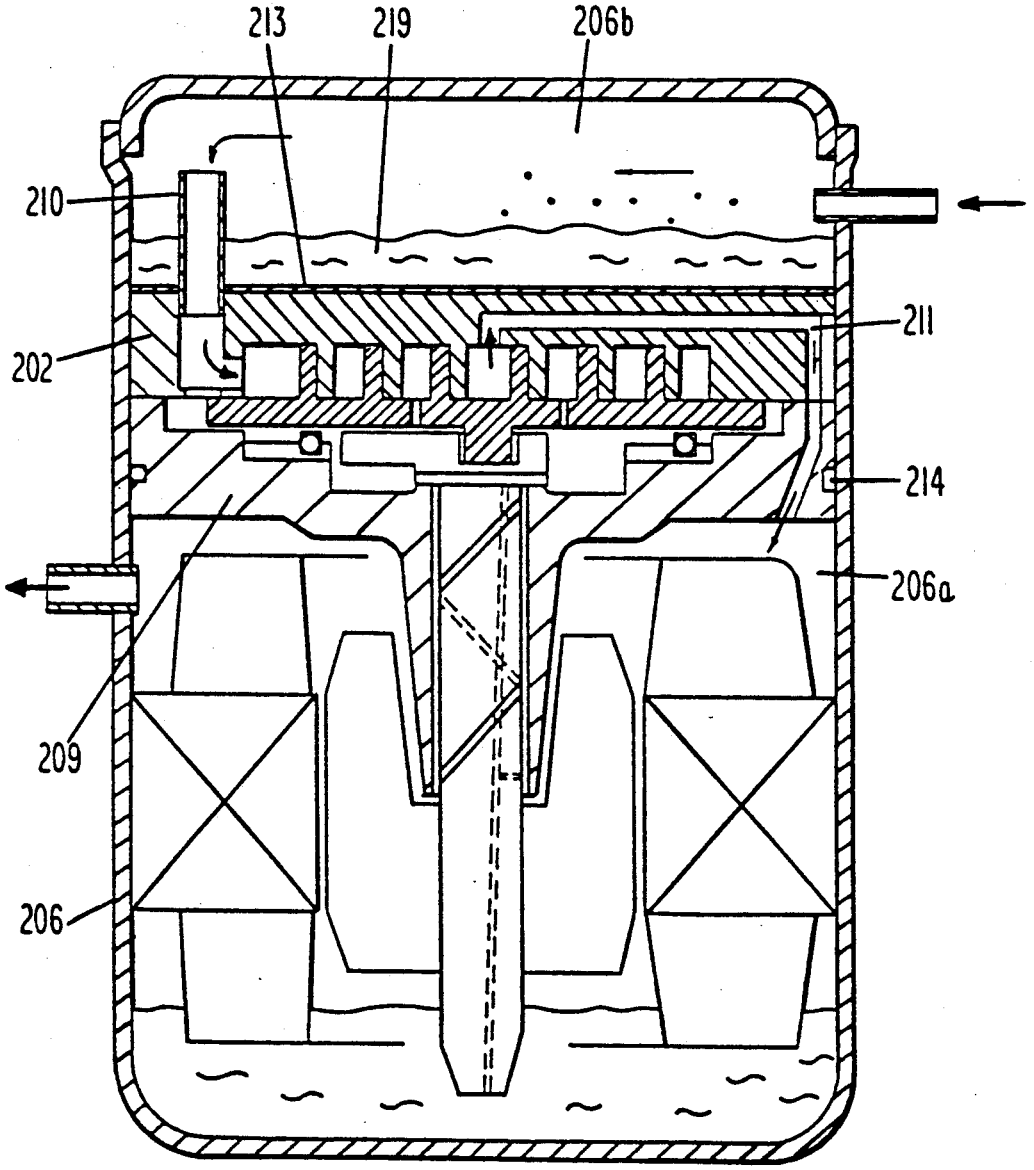
PRIOR ART Fig. 19
FIG. 19 is a front sectional view showing a conventional scroll gas compressor housing therein an accumulator.

FIGS. 15 and 16, respectively, show other scroll compressors with different accumulator chambers. The gas-liquid separation chamber 84*a* of an accumulator chamber 46*a* in FIG. 15 is divided into a liquid collection chamber $84a_1$ and a suction chamber $84a_2$ by a partition wall 82*b* provided at the inner wall of heat insulating cover 82*a* of resin superior in insulation characteristics, and the upper end of the partition wall 82*b* extends higher than the lower end of the suction guide bore 86*a* provided at the baffle 83*a*. Therefore, the liquid refrigerant flowing-in from the suction pipe 47 is not evaporated and does not flow into the suction guide bore 86*a*.

An accumulator chamber 46*b* in FIG. 16 is so constructed that the suction chamber $84a_2$ in FIG. 15 is partitioned into two chambers by a partition wall $83b_1$ extending downward from the baffle 83*b*, in which the intake refrigerant passage is long, and the gas-liquid mixture refrigerant flowing with the accumulator chamber 46*b* is low at the temperature, thereby being suitable for a compressor for refrigeration cycles operated in conditions of less vaporation of refrigerant in the accumulator chamber 46*b*.

Next, an explanation will be given on operation of the scroll gas compressor of the invention constructed as above-mentioned.

In FIGS. 1 through 16, when the drive shaft 4 rotates by the motor 3, the whirling scroll 18 will rotate around the main shaft at the drive shaft 4 by a crank mechanism thereof, but the parallel key portion 24*b* at the Oldham's ring 24 engages with the keyway 71 at the whirling scroll 18 and the straight portions 25 engage with the straight portions at the thrust bearing 20 restrained from its rotation, so that the rotation is blocked and the revolution is carried out to change, together with the fixed scroll 15, the volume of the compression chamber, and suction and compression operations on the gas refrigerant are carried out.

The intake refrigerant of gas-liquid mixture including lubricating oil from the refrigeration cycle connected to the compressor flows from the suction pipe 47 to the accumlator chamber 46, collides with the baffle 83, and is gas-liquid-separated by a weight difference between the gas and the liquid or inertia when the direction changes. The liquid refrigerant is then collected at the bottom of the accumulator chamber 46.

The heat of the motor chamber 6 transferred to the lower enclosed casing 1*b* through the upper enclosed casing 1*a* is insulated by the heat insulating cover 82 and baffle 83 having heat insulating characteristics, thereby reducing heat-transfer to the intake refrigerant.

Collision noises or vibrations caused, when the refrigerant flows in the accumulator chamber 46 and collides with an inner wall or the like, are shielded or absorbed by the heat insulating cover 82.

The separated intake gas flows in the suction chamber 17 sequentially through the suction guide bore 86, the intake passage 42 and the suction bore 43, and is shut in the compression chamber through the first compression chambers 61*a* and 61*b* formed between the whirling scroll 18 and the fixed scroll 15, and sequentially transferred to the second compression chambers 51*a* and 51*b* that always beam an enclosed space and the third compression chambers 60*a* and 60*b*, thereby being discharged to the motor chamber 6 from the central discharge port 16 through the discharge passage 80 against a biasing force of the check valve 50.

Since the gas refrigerant is compressed in the compression chamber, a differential pressure between the pressure at the compression chamber and that of the accumulator chamber 46 deflects the panelboard 15*b* at the fixed scroll 15 towards the accumulator chamber 46, in which the deflection is larger at the central portion of panelboard 15*b* and smaller at the outer peripheral portion. As a result, the axial gap of the compression chamber deformed to be restricted at the central portion when the compressor is assembled, is corrected to be uniform at both the central portion and the outer peripheral portion.

The central portions of the fixed scroll wrap 15*a* and the whirling scroll wrap 18*a* are higher in temperature and larger in expansion dimension than the outer peripheral portions thereof, respectively. As a result, the axial gap at the compression chamber is kept narrow at the central portion and wide at the outer peripheral portion, thereby reducing leakage of compressed gas refrigerant at the central portion where a pressure difference between the compression chambers is large.

The discharged gas refrigerant discharged slantwise inwardly from the utmost end of discharge gas guide 81 collides against the rotor 3*a* at the motor 3 and the balance weight 75 to be diffused, flows in an upper space of the motor chamber 6 while cooling the motor 3 through the cooling passage 35 at the outer periphery of stator 3*b* after having passed between the windings of lower coil end 30*a* at the motor 3, and, after again inwardly changing flow direction, is delivered to the external refrigeration cycle from the discharge pipe 31 at the outer peripheral portion through a punched bore 90 at the center.

At this time, lubricating oil in the discharge gas refrigerant attached in part to the surfaces of many windings at the motor coil end is separated from the gas refrigerant and collected at the sump 34 at the discharge chamber.

The lubricating oil at the bottom of the sump 34 oil-film-seals leakage of the high pressure gas refrigerant at the motor chamber 6 through the fixing face at which the panelboard 15*b* of the fixed scroll 15 and the partitioning liner 79 are shrink-fitted to each other, and flows in the back pressure chamber 39 through the process to be discussed below so as to gradually raise the pressure of the back pressure chamber. The back pressure biases the wrap support disc 18*c* at the whirling scroll 18 to contact with the panelboard 15*b* at the fixed scroll 15, whereby the axial gap at the compression chamber is eliminated to seal it and the intake gas refrigerant is efficiently compressed to continue safe operation.

Since the fixed scroll 15 of aluminum alloy is larger in thermal expansion coefficient than the partitioning liner 79 of iron, the tightening force by shrink fitting of partitioning liner 79 increases with an increase in temperature when the compressor operates, thereby further reducing leakage of high pressure gas refrigerant from the motor chamber 6 to the accumulator chamber 46. Also, the pressure of the compressed gas refrigerant prevents the compression chamber from swelling toward the accumulator chamber 46 so as to expand the axial gap at the compression chamber. At the initial start of the compressor for refrigeration from the state where the pressure in the compressor balances and liquid refrigerant exists in the compression chamber as well as the accumulator chamber 46, the pressure of the compressed refrigerant in the compression chamber applies to the whirling scroll 18 a thrust force in the reverse direction to the discharge port 16, but since the back pressure required for biasing is not produced at the rear surface of the whirling scroll 18, the whirling scroll 18 leaves the fixed scroll 15 and is supported to the thrust bearing 20. At this time a gap of about 0.015 to 0.020 mm is produced axially of the compression chamber. As a result, the pressure in the compression chamber temporarily lowers to reduce the compression load at the initial start.

In addition, the initial supporting force of the thrust bearing 20 to support the whirling scroll 18, as discussed below, depends on an elastic force of a seal ring 70 and an auxiliary spring device (for example in specification of U.S. Pat. No. 3,600,114).

If liquid compression occurs in the compression chamber to instantaneously abnormally raise the pressure in the compression chamber, the thrust force acting on the whirling scroll 18 is larger than the biasing force acting on the rear surface of the whirling scroll 18 so that the whirling scroll 18 axially moves, the wrap support disc **18*c* of the whirling scroll 18 leaves the panelboard 15*b* at the fixed scroll 15 to be supported to the thrust bearing 20**, and the sealing for the compression chamber is released to lower the pressure in the compression chamber and reduce compression load.

The lubricating oil in the sump 34 is taken into from the oil bore **38*b* and supplied to the thrust ball bearing 13 by screw pumping operation of the spiral oil groove 41 provided at the surface of the upper shaft 4*a* at the drive shaft 4, so that, when the lubricating oil passes the fine bearing gap at the end of upper shaft 4*a*, the sealing operation of the oil film shields the discharge gas refrigerant atmosphere in the motor chamber 6 from the upper side space of the upper bearing 10**.

The lubricating oil including the dissolved discharge gas refrigerant, when passing the fine gap at the lower bearing 11, is decompressed to an intermediate pressure between the discharge pressure and the suction pressure and flows into the back pressure chamber 39, and thereafter flows into the outer peripheral space 37 through the oil groove **40*a* at the eccentric bearing 14 the eccentric bearing space 36, and the oil bore 38 passing the whirling scroll 18**, while being gradually decompressed.

On the other hand, when the rotation speed of the drive shaft 4 is under the set number of rotations (for example, 6000 rpm), since a centrifugal force that is generated at the plunger 94 based on a whirling movement of whirling scroll 18 is smaller than the biasing force of the coil spring 95, the end face of plunger 94, as shown in FIG. 10, is stationary in contact with the bottom surface of the larger diameter cylindrical bore **92*a*, so that the cylindrical groove 98*c* connecting with the passage 98*a* does not connect with the bypass bore 99 at the wrap support disc 18*c*, but connects through the stepped smaller diameter cylindrical bore 92, the longitudinal groove 93*a* at the valve body 93, and the smaller diameter injection bores 52*a* and 52*b* with the second compression chambers 51*a* and 51*b* not connecting with both the discharge port 16 and the suction chamber 17**.

Therefore, the lubricating oil in the outer peripheral space 37 flows through the oil passage 96 at the wrap support disc **18*c*, the oil bore 38*c*, and the smaller diameter injection bores 52*a* and 52*b*, into the second compression chambers 51*a* and 51*b* not connecting with the discharge port 16 and the suction chamber 17**, thus lubricating the respective sliding surfaces on the way of the oil passage.

The lubricating oil injected into the second compression chambers **51*a* and 51*b* joins with lubricating oil flowing together with the intake gas refrigerant into the compression chamber, thereby sealing the fine gap between the adjacent compression chambers by an oil film so as to prevent leakage of the compressed gas refrigerant, and then, while lubricating the respective sliding surfaces, is redischarged into the motor chamber 6 through the discharge port 16**.

Since the sump 34 at the discharge chamber connects with the annular groove 28 and the release gap 27, the thrust bearing 20 is biased by the back pressure to abut against the end face of spacer 21. The wrap support disc **18*c* at the whirling scroll 18 smoothly slides keeping the fine gap between the thrust bearing 20 and the panelboard 15*b* at the fixed scroll 15 and the gap between the end face of fixed scroll wrap 15*a* and the wrap support disc 18*c* and the gap between the end face of the whirling scroll wrap 18*a* and the panelboard 15*b*** are held minutely, thereby reducing a gas leakage between the adjacent compression chambers.

The openings of injection bores **52*a* and 52*b* at the second compression chambers 51*a* and 51*b*, as shown in FIG. 14, vary in pressure, the pressure being instantaneously higher than the back pressure 68 varying following the pressure in the motor chamber 6, but lower in mean pressure. Therefore, the lubricating oil from the back pressure chamber 39 intermittently flows into the second compression chambers 51*a* and 51*b*. Also, the compressed gas refrigerant in the second compression chambers 51*a* and 51*b*, the pressure of which is instantaneously higher than pressure 68 in the back pressure chamber when the compressor normally operates, is decompressed at the smaller diameter injection bores 52*a* and 52*b*, thereby reducing instantaneous reverse current of oil to the oil bore 38*c* so that the pressure in the oil bore 38*c* is not higher than the pressure 68** in the back pressure chamber.

At the initial stage of start-up of the compressor, the whirling scroll 18 is supported by the elastic force of the seal ring 70 or the spring device through the thrust bearing 20, but the lubricating oil supplied to the back pressure chamber 39 after the start of the compressor is stabilized, applies the biasing force of mean pressure to the whirling scroll 18 so as to urge the wrap support disc **18*c* against the sliding surface to the panelboard 15*b* and seals it by oil film, thereby cutting off communication between the outer peripheral space 37 and the suction chamber 17. The lubricating oil in the back pressure chamber 39 is interposed at a gap between the sliding surfaces of the thrust bearing 20 and the wrap support disc 18c** to seal the gap (about 0.015 to 0.020 mm).

The pressure of lubricating oil in the back pressure chamber 39 warps the wrap support disc 18c at the whirling scroll 18 toward the compression chamber so that, as the same as the fixed scroll 15, the axial gap at the center of the compression chamber is restricted, thereby reducing leakage of the compressed gas refrigerant between the compression chambers.

For a while after the compressor starts for refrigeration, as seen from FIGS. 13 and 14, the pressure of the motor chamber 6 is lower than those in the second compression chambers 51a and 51b and the gas refrigerant under compression will reversely flow to the back pressure chamber 39 through the check valve 91. However, as shown in FIG. 11, the checking operation of the valve body 93 blocks back flow toward the peripheral space 37 by the checking operation of the valve body 93 and the lubricating oil in the sump 34 is supplied under differential pressure to the back pressure chamber 39 and the outer peripheral space 37.

In other words, for a while after the compressor starts for refrigeration, the pressure of lubricating oil at the outer peripheral space 37 is low. Therefore, the gas refrigerant on the way to compression reversely flows from the injection bores 52a and 52b to the stepped smaller diameter cylindrical bore 92, and the valve body 93 moves toward the outer peripheral space 37 in the state of closing the end face of plunger 94 against the biasing force of the coil spring 95, so that the coil spring 95 is contracted to about close-contact conditions and stopped, whereby the cylindrical groove 98c connects with the smaller diameter bypass bore 99. Hence, the compressed gas refrigerant is restrained from reversely flowing from the second compression chambers 51a and 51b to the outer peripheral space 37, and the outer peripheral space 37 connects with the suction chamber 17. As a result, the lubricating oil in the discharge chamber sump 34 flows into the suction chamber 17 sequentially through the back pressure chamber 39 and the outer peripheral chamber 37, thereby lubricating the sliding portion on the way of oil supply.

Thereafter, the pressure of lubricating oil in the outer peripheral space 21 rises as the pressure at the motor chamber 6 rises, and the valve body 93 moves to the position shown in FIG. 10 by a differential pressure to the stepped smaller diameter bore 92, the lubricating oil being injected from the injection bores 52a and 52b to the second compression chambers 51a and 51b, thereby cutting off the passage to the suction chamber 17.

When the pressure in compression chamber rises to an extreme because the pressure of the intake gas refrigerant is very high as just after the compressor starts and a compression ratio of the scroll compressor is constant, or when abnormal liquid compression occurs, the whirling scroll 18, as above-mentioned, leaves the fixed scroll 15 to be supported to the thrust bearing 20. However, the thrust bearing 20 biased by back pressure cannot bear a thrust load caused by abnormally rising pressure in the compression chamber so as to act on the whirling scroll 18, and moves backwardly in the direction of reducing the release gap 27, thereby enlarging the axial gap between the whirling scroll 18 and the fixed scroll 15. Hence, much leakage is created between the compression chambers to rapidly lower the pressure in the compression chamber, and after the compressed load is reduced, the thrust bearing 20 is instantaneously restored, so that the pressure in the back pressure chamber 39 does not lower so as to continue safe operation.

When a foreign object is bitten in the axial gap between the whirling scroll 18 and the fixed scroll 15, in the same way as mentioned above, the thrust bearing 20 moves backwardly to remove the foreign object.

Also, when instantaneous liquid compression is caused during the initial start for refrigeration or the normal operation, the pressure in the compressing chamber causes an abnormal pressure rise and an excessive compression as shown by the dotted line 63 in FIG. 13, but since the high pressure space volume connecting with the suction port 16 is large, the pressure rise at the motor chamber 6 is extremely small.

The stepped smaller diameter cylindrical bore 92 connecting with the second compression chambers 51a and 51b by the liquid compression abnormally rises in pressure, but the check operation of the check valve 93 is cut off between the outer peripheral space 37 and the stepped smaller diameter cylindrical bore 92. As a result, the pressure in the back pressure chamber 39 is not changed and the back pressure biasing force acting on the rear surface of the thrust bearing 20 is not changed. As a result, in liquid compression operation, an excessive thrust force acting on the whirling scroll 18 moves the thrust bearing 20 backwardly as mentioned above, and the pressure in the compression pressure lowers to continue normal operation.

Since the thrust bearing 20 moves backwardly on the way of liquid compression, the pressure in the compression chamber lowers halfway as shown by the one-dot chain line 63a in FIG. 13.

The differential pressure lowers as leakage of compressed gas per unit time decreases and the amount of oil injected to the compression chamber is restricted. When the compressor operates at high speed (for example, at the number of rotations of the motor 3 of 8,000 rpm) to gradually raise the pressure in the back pressure chamber 39, a resulant force of centrifugal forces generated at both the check valve 93 and the plunger 94 following a whirling motion of the whirling scroll 18 becomes larger than the biasing force of the coil spring 95. The check valve 93 and the plunger 94 move against the biasing force of the coil spring 95 and stop in the position shown in FIG. 11 in the same way as that of the generation of liquid compression. Therefore, the outer peripheral space 37 and the second compression chambers 51a and 51b are cut off therebetween, the outer peripheral space 37 connecting with the suction chamber 17. Lubricating oil in the outer peripheral space 37 does not flow in the second compression chambers 51a and 51b, but is decompressed when passing through the bypass bore 99 and flows into the suction chamber 17. The inflow of lubricating oil to the suction chamber 17 lowers to a proper back pressure the pressure of the back pressure chamber 39 connecting with the outer periphery space 37 so that the biasing force of the whirling scroll 18 to the fixed scroll 15 is properly held. The lubricating oil flowing into the suction chamber 17 together with the intake gas refrigerant is taken in the compression chamber, and thereafter discharged to the motor chamber 6.

When the pressure in the back pressure chamber 39 abnormally rises, frictional heat generates at the sliding surfaces between the wrap support disc 18c at the whirling scroll 18 and the panelboard 15*b* at the fixed scroll 15, and the coil spring 95 exceeds the set temperature so as to weaken the biasing force to the plunger 94. As a result, the plunger 94 moves toward the coil spring 95 in the same way as that at the high speed operation of the compressor, and stops in the position shown in FIG. 11. The suction chamber 17 connects with the outer peripheral space 37 and the pressure in the back pressure chamber 39 lowers to be kept proper.

After the compressor stops, the pressure in the compression chamber causes a reverse whirling torque at the whirling scroll 18 so that the whirling scroll 18 reversely whirls and the intake gas refrigerant reversely flows to the intake side. The check valve 50 moves from the position shown in FIG. 1 toward the discharge port 16 following the reverse flow of the discharged gas refrigerant, and seals the bottom of the check valve bore 50*a* to block the reverse flow of the discharged gas refrigerant, whereby the reverse whirling of the whirling scroll 18 stops and the space between the suction passage 42 and the gas passage 80*c* holds the pressure at the suction side.

When the pressure in the motor chamber 6 lowers to a certain extent, lubricating oil in the discharge chamber sump 34 is stopped by passage resistance of oil supply passages from being supplied by its differential pressure to the outer peripheral space 37.

During the operation of the compressor, the upper bearing 11 connects at the upstream oil supply side with the discharge chamber sump 34 and at the downstream oil supply side with the back pressure chamber 39 in intermediate pressure conditions, thereby generating a differential pressure therebetween so as to bias toward the whirling scroll 18 the drive shaft 4 fixing the rotor 3*a* of the motor 3. The biasing force is applied to the body frame 5 through the thrust ball bearing 13 so as to restrain the drive shaft 4 from falling caused by unbalance or compression load thereon in a range of the gap between the upper bearing 10 and the main bearing 12, thereby preventing one-sided contact of the upper bearing 10 with the main bearing 12.

A temperature rise at the time when the compressor operates allows the body frame 5 of aluminum alloy to thermal-expand so as to expand the liner 8 of iron, so that close contact of the outer periphery of the liner 8 with the inner wall of enclosed casing 1 is strengthened, thereby improving rigidity.

In the afore-mentioned example, the lubricating oil in the sump 34 is injected to the second compression chambers 51*a* and 51*b*, but can alternatively be injected, under conditions of using the compressor or other conditions, into the first compression chamber 61*a* and 61*b* connecting with the suction chamber 17.

Moreover, in the afore-mentioned example, lubricating oil in the sump 34 is guided into the release gap 27 and the annular groove 28 provided at the rear of the thrust bearing 20, but the intermediate pressure gas refrigerant can alternatively be introduced from the discharged gas refrigerant in the motor chamber 6 or the second compression chambers 51*a* and 51*b*.

Moreover, the discharge passage 80 is provided with the check valve 50, but a free-valve type check valve vertically operable can be provided between the suction chamber 17 and the suction bore 43 in light of the inner volume of the enclosed casing 1 or the amount of lubricating oil.

A suction passage 85 is provided between the suction guide 86 and the suction bore 43 but the suction bore 43 can directly connect with the suction guide 86.

Moreover, the liner 8 is shrink-fitted to the outer periphery of the fixed scroll 15 and the contracting force of the liner 8 deforms the central portion of the fixed scroll wrap 15*a* toward the whirling scroll 18, so that the axial gap at the center of the compression chamber is previously restricted, but when the liner 8 is not shrink-fitted or the margin for shrink-fitting is small, the utmost end of the fixed scroll wrap 15*a* or the bottom of the spiral groove can previously be manufactured by the same method as the above-mentioned.

As seen from the above, according to the afore-mentioned example, the scroll compressor is constructed as follows: The whirling scroll 18 engages with the fixed scroll member 15*e* that comprises the fixed scroll 15 and the partition liner 79 shrink-fitted thereto. In the enclosed casing 1 of iron is housed the scroll compression mechanism, in which the Oldham's ring 24 that is a rotation blocking member for the whirling scroll 18 is disposed between the whirling scroll 18 and the body frame 5 that supports the drive shaft 4 and fixes the fixed scroll member 15*e* thereto. The fixed scroll member 15*e* comprising the fixed scroll 15 of aluminum alloy and the thin cylindrical partition liner 79 of iron shrink-fitted to the outer periphery of panelboard 15*b* partitions the inside of the enclosed container 1 into the motor chamber 6 at the high pressure side and the accumulator chamber 46 at the low pressure side for gas-liquid-separating the intake refrigerant and storing it. The accumulator chamber 46 is disposed below and the motor chamber 6 is above. At the motor chamber 6 are disposed the discharge chamber sump 34 and the driving unit that comprises the motor 3 in connection with the scroll mechanism, the drive shaft 4 connected to the motor 3, the body frame 5 supporting the drive shaft 4, and the Oldham's ring 24, for preventing the rotation of the whirling scroll, engageable with the body frame 5. The fixed scroll member 15*e* serves as part of the bottom of sump 34. Accordingly, the lubricating oil, which is separated from the discharged gas refrigerant compressed together with the intake gas refrigerant separated from liquid at the accumulator chamber 46 for preventing liquid compression, flows downwardly and is collected in the sump 34 disposed under the frame 5 and near the fixed scroll member 15*e* without being subjected to diffusion caused by the flow rate of the discharged gas refrigerant or the rotation of the rotor 3*a* at the motor 3 even when the compressor operates at high speed, thereby enabling the oil level to be reliably held. Therefore, oil supply to either the bearing slide portions or the compression chambers is permanently possible to thereby enable prevention of wearing at the slide portion, reduction of friction and sealing the gap between the compression chambers by an oil film, thus providing a compressor superior in durability of slide portion and compression efficiency. Moreover, the space formed between the fixed scroll member 15*e* and the outer peripheral portion of body frame 5 is utilized so that the sump 34 required for lubricating oil storage can increase in depth and the motor chamber 6 is reducible in height and the compressor can be miniaturized. Also, since the compression mechanism, the accumulator chamber 46 and the discharge chamber sump 34 are disposed at the lower portion of the compressor, the center of gravity of the compressor is lowered and the radial vibration (rolling) at the upper portion of the compressor is reducible.

Since the fixed scroll member 15*e* forming the accumulator chamber 46 and the inner wall of the lower enclosed casing 1*b* are covered by a heat insulating cover 82 of resin provided with a heat insulation and a soundproof effect and by baffle 83, heat transfer from the lower enclosed casing 1*b* and the motor chamber 6 heated at a high temperature by heat from the upper enclosed casing 1*a* that is heated by heat from the compressed gas refrigerant, the slide portion and the motor 3, and also heat transfer from the fixed scroll member 15*e* heated by heat from the compression chamber can be cut off by the heat insulating cover 82 and baffle 83, thereby reducing heating to the intake gas refrigerator intake liquid refrigerant and preventing lowering of the compression efficiency. Accordingly, it is possible to gas-liquid-separate the intake refrigerant and incorporate the accumulator chamber 46 with a storage function into the enclosed casing 1, thereby reducing the extension size of the compressor.

With a conventional compressor that has an accumulator separated therefrom, resonance of the accumulator and vibration of the piping connected to the compressor following vibration of the compressor are created, but they are not created in the compressor of this invention thereby enabling the apparatus constituting the refrigeration cycle to be reduced in vibrations and noises.

Since both heat insulating cover 82 and the baffle 83 comprising soft material each have a low specific frequency and a soundproof function, neither collision sound of the intake refrigerant flowing into the accumulator chamber 46 and colliding against the inner wall thereof nor expansion sound generated at the time when the gas-liquid separation is carried out are propagated to the outside of the compressor. Especially, the scroll compressor is naturally silent to be effectively soundproof, and an extremely silent scroll compressor can be provided.

Since the accumulator chamber 46 is at the bottom of the compressor, the gas space side for intake refrigerant is near the high temperature motor chamber 6 and the refrigerant in the gaseous condition of small density is low in heat conductivity, heating to the intake refrigerant is further reducible.

Also, since the accumulator chamber 46 provided with the gas-liquid separation and storage function has an intake passage 85 through which the intake gas refrigerant is taken-in from the upper portion into the compression chamber, even if during the stop of the compressor the accumulator chamber 46 is filled with liquid refrigerant, no liquid refrigerant flows into the compression chamber, thereby reducing liquid compression when the compressor starts, and decreasing the generation of vibration of the compressor and abnormal noise, so that durability of the compressor can be improved.

Moreover, the partitions 82*b* (82*d*), 83*b*1 projecting from the inner walls of the heat insulating covers 82*a*, (82*c*) and the baffles 83*a* (83*b*) are used to form in the accumulator chamber 46 (46*a*, 46*b*) suction chambers 46*a*1 (46*b*1) of a bypass for the intake gas refrigerant separated at the gas-liquid separation chamber, so that the intake refrigerant passage can be simple and long, thereby preventing the gas-liquid mixture refrigerant flowing-in from the suction pipe 47 from flowing into the compression chamber through the short circuit, expecting vaporization of the intake refrigerant on the way and reducing the compression load.

Also, the overload reducing mechanism of a method to enlarge the axial gap at the compression chamber is provided, so that some liquid compression operation is possible and the volume of accumulator chamber 46 is reducible to lower the gas-liquid separation efficiency. As a result, since a heat transfer surface of the motor chamber 6 or the like is reducible, thereby enabling heat absorption of the intake refrigerant to be reduced and the compression efficiency to be improved, thus providing a small-sized scroll refrigerant compressor.

The fixed scroll member 15*e* comprises the fixed scroll 15 of aluminum alloy that forms the compression chamber together with the whirling scroll 18 and the partition liner 79 that is shrink-fitted to the outer periphery of panelboard 15*b* at the reverse whirling scroll side of the fixed scroll 15 and made of the same material as the enclosed casing 1. The ridge 79*a* at the partition liner 79 and the enclosed casing 1 are welded to be sealed, thereby constituting part of the accumulator chamber 46 so that the enclosed casing 1 can be partitioned therein into the high pressure motor chamber 6, the partition liner 79 and the low pressure accumulator chamber 46 in contact with the panelboard 15*b* at the fixed scroll 15, by the use of simple structural materials, whereby the compressor is inexpensive to produce and high in reliability for sealing partition. Hence, the scroll refrigerant compressor that is provided with the accumulator chamber 46 and the fixed scroll 15 adjacent thereto can be inexpensively produced with extreme reliability.

The panelboard 15*b* at the fixed scroll 15 is warped toward the compression chamber by the contracting force of the enclosed casing 1 when welded with the ridge 79*a* at the liner 79 and the shrink-fitting force of the partition liner 79, thereby keeping the axial gap small when assembled. In such a state, the scroll refrigerant compressor operates to urge the center of panelboard 15*b* at the fixed scroll 15 to the accumulator chamber 46 by means of a differential pressure between the compressed refrigerant pressure and the intake pressure in the accumulator chamber 46 and easily prevents the axial gaps at the center and the outer periphery of the compression chamber from expanding to keep a proper gap at the compression chamber, thereby reducing leakage of the compressed gas refrigerant and preventing lowering of the compression efficiency.

Furthermore, the shrink-fitting margin of the panelboard 15*b* at the fixed scroll 15 and partition liner 79 can be increased to enlarge the tightening force of the liner 79, whereby the fixed scroll 15 is larger in warp when the fixed scroll 15 is assembled to restrict the axial gap at the center of the compression chamber and to extremely reduce leakage of the compressed gas refrigerant, thereby improving the compression efficiency.

Since the fixed scroll 15 is formed of aluminum alloy and is larger in thermal expansion coefficient than the liner 79 of soft iron and the enclosed casing 1 of the same, as a result of temperature rise due to compression heat or frictional heat when the compressor operates, the panelboard 15*b* at the fixed scroll 15 is expanded more than the liner 79, the liner 79 is expanded in pipe diameter to increase contact surface pressure of the shrink-fitting portion and the compressed gas refrigerant in the motor chamber 6 is reduced in leakage thereof to the accumulator chamber 46 through the shrink-fitting surface. The surface of the fixed scroll 15 of aluminum alloy is softer than that of liner 79, whereby the fixed scroll 15 and the liner 79 are easy to close-contact with each other so that leakage of the compressed gas refrigerant through the shrink-fitting surface is further reducible.

Since the diameter of the outer periphery of the panelboard 15*b* at the fixed scroll 15 at the accumulator chamber 46 is made smaller than that at the motor chamber 6 side, the liner 79 is press-fitted to the outer periphery at the accumulator chamber 46 side, so that the differential pressure between the motor chamber 6 and the accumulator chamber 46, or that between the compression chamber and the accumulator chamber 46, prevents the fixed scroll 15 from escaping from the partition liner 79, thereby enabling the reliability for shrink-fitting to be raised.

The fixed scroll member 15*e* comprises the fixed scroll 15 and the partition liner 79 constructed as above-mentioned. The ridge 79*a* at the liner 79 and the enclosed casing 1 are welded in a sealing manner. The enclosed casing 1 is partitioned therein into the motor chamber 6, liner 79 and the accumulator chamber 46 as above-mentioned. The motor chamber 6 serving also as the discharge chamber is disposed at the upper portion of the enclosed casing 1, and the accumulator chamber 46 at the low pressure side at the lower portion, whereby the lubricating oil separated from the discharged gas refrigerant at the motor chamber 6 can be collected at the bottom thereof, which is utilized to oil-film-seal the shrink-fitting surfaces of the fixed scroll 15 and the liner 79, so that the discharged gas refrigerant in the motor chamber 6 can be prevented from leaking into the accumulator chamber 46 through the shrink-fitting surface.

The enclosed casing 1 is partitioned therein into the motor chamber 6 at the high pressure side and the accumulator chamber 46 at the low pressure side by the fixed scroll member 15*e*. The body frame 5 supports the drive shaft 4 and fixes the fixed scroll member 15*e*. The body frame 5 and the enclosed casing 1 are fixed to each other by the liner 8, thereby increasing rigidity of the central portion of the enclosed casing 1, and thereby reducing vibrations of the thin wall of the enclosed casing 1 by discharge pulse in the discharge-side space (i.e., the motor chamber 6) restricted by partition in the enclosed casing 1 and generation of noise following the pulse.

The enclosed casing 1 is partitioned therein by the fixed scroll member 15*e* into the motor chamber 6 and the accumulator chamber 46, which are welded to be sealed. To the outermost periphery of the body frame 5 fixed to the fixed scroll member 15*e* is fixedly press-fitted the liner 8 of a thin cylinder made of the same material as the enclosed casing 1. The outer periphery of the liner 8 and the enclosed casing 1 are welded to each other. Thus, even when a remarkable temperature difference is created between the compression mechanism and the enclosed casing 1, a proper slip is produced between the liner 8 and the body frame 5, thereby preventing generation of stresses following the thermal expansion at the compression mechanism and the enclosed casing 1. The enclosed casing 1 supports the compression mechanism to the fixed scroll member and the body frame so as to prevent a deflection of the compression mechanism, thereby expecting low vibration and low noises at the compressor.

The discharge chamber oil sump 34 and the compression chamber connects with each other by the oil supply passage having restricted passage of the fine axial gap or injection bore 52*a* or 52*b*. At part of the oil supply passage is provided the oil bore B38*b* having the route higher than the oil level at the discharge chamber oil sump 34. Accordingly, during the stop of the compressor, the lubricating oil in the sump 34 above the compression chamber is intended to flow into the compression by its weight through the injection bores 52*a* and 52*b*, but the oil is blocked by the upper passage 38*b* higher than the oil level at the sump 34, thereby eliminating the inflow of the lubricating oil. Thus, it is possible to prevent liquid compression at the time when the compressor starts, impossible start, breakdown, or lowering of the compressor.

Although the afore-mentioned example discloses operation of a refrigerant compressor alone, the same effect as the above can be expected in a gas compressor for oxygen or nitrogen using lubricating oil, a refrigerant pump, or a liquid pump, such as a hydraulic pump.

As seen from the above, the compressor of the invention is so constructed that the scroll compression mechanism is housed in the enclosed container. The enclosed container is partitioned by the fixed scroll member into the high pressure chamber and the low pressure chamber in which the intake fluid is gas-liquid-separated and stored. The low pressure chamber is disposed at the lower portion of the container and the high pressure chamber is at the upper portion. The drive unit in connection with the scroll compression mechanism and the lubricating oil sump are disposed in the high pressure chamber, and the fixed scroll member serves also as part of the bottom of the lubricating oil sump, so that the lubricating oil, which is separated from the discharge gas to the high pressure chamber and compressed together with the intake gas separated from the liquid at the low pressure chamber for preventing liquid compression, is not subjected to diffusion caused by a flow rate of the discharge gas or high speed rotation of the rotor at the drive unit even when the compressor operates at high speed, and is collected at the bottom of the lubricating oil sump, thereby reliably holding the oil level. Therefore, oil supply to the bearing slide portion in connection with the scroll compression mechanism and the compression chamber is always possible, whereby the wearing at the slide portion can be prevented, friction thereof is reducible, and the gap at the compression chamber can be sealed by an oil film action. Hence, a compressor superior in durability of the slide portion and compression efficiency can be provided. Also, the lubricating oil sump required for storing the oil can be larger in depth utilizing the space such as that at the outer periphery of the fixed scroll member, thereby enabling the high pressure chamber to be reduced in height and the compressor to be of small-size.

Moreover, since the compression mechanism, the low-pressure chamber, and the lubricating oil sump are disposed in the lower portion of the compressor. The center of gravity of the compressor is low and the radial vibrations (rolling) at the upper portion of compressor is reducible.

A margin for press-fitting of the panelboard and the liner is increased and the tightening force of the liner is increased so as to increase a warping deformation at the time when the fixed scroll is assembled and the axial gap at the central portion of the compression chamber is restricted to significantly reduce leakage of compressed fluid, thereby expecting an improvement in the compression efficiency. Hence, the low pressure chamber housing type scroll fluid apparatus provided with gas-liquid separation and storage of the intake fluid can be inexpensive to produce and improved in compression efficiency.

The body frame member that supports the drive shaft for the scroll compression mechanism and that is fixed to the fixed scroll member is fixed to the enclosed container, thereby increasing rigidity. Accordingly, vibration of the thin wall of the enclosed container by discharge pulse in the high pressure chamber that is restricted by being partitioned into the high and low pressure chambers in the enclosed container and generation of noises that follows the vibrations can be reduced.

Furthermore, the body frame member comprises the liner of a thin cylinder made of the same material as the enclosed container and disposed at the outermost periphery thereof, and the outer periphery of the liner and the enclosed container are welded, so that even when a remarkable temperature difference is created between the compression mechanism and the enclosed container, a proper slip is generated between the liner and the body frame so as to prevent generation of stress following a thermal expansion at the compression mechanism and the enclosed container. Besides, the enclosed container supports the compression mechanism by two portions of the fixed scroll member and the body frame, thereby preventing a deflection of the compression mechanism and expecting low vibrations and low noises of the compressor.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A scroll gas compressor comprising an enclosed container and a scroll compression mechanism that is housed in said container, said container being partitioned therein by a fixed scroll member into a high pressure chamber and a low pressure chamber in which intake fluid is gas-liquid-separated and stored, said low pressure chamber being disposed at the lower portion of said container and said high pressure chamber being disposed at the upper portion of said container, at said high pressure chamber being disposed a driving mehanism related to said scroll compression mechanism and a lubricating oil sump, and with said fixed scroll member serving as part of the bottom surface of said lubricating oil sump, wherein a whirling scroll wrap on a wrap support disc of part of a whirling scroll is swingably and rotatably engaged with respect to a spiral fixed scroll wrap formed at one surface of a panelboard of part of said fixed scroll member, a spiral compression space is formed between both said scrolls, a discharge port is provided at the central portion of one of said scroll wraps, a suction chamber is provided outside of said fixed scroll wrap, said compression space is partitioned into a plurality of compression chambers continuously traveling from the suction side to the discharge side, and a rotation blocking member for said whirling scroll is disposed between said whirling scroll and a fixed member to form said scroll compression mechanism for whirling said whirling scroll in order to compress fluid.

2. A scroll gas compressor as set forth in claim 1, wherein a major part of an inner wall member forming said low pressure chamber is covered by a member of low natural frequency, said member being made of a low specific gravity and soft material and having both heat insulating and sound proof characteristics.

3. A scroll gas compressor as set forth in claim 2, wherein said lubricating oil sump connects with said compression chamber through an oil supply passage having a restriction passage, part of said oil supply passage having a route positioned higher than the oil level at said lubricating oil sump.

4. A scroll gas compressor as set forth in claim 2, wherein said low pressure chamber has a suction passage through which said fluid is taken into said compression chamber from the upper potion of said low pressure chamber.

5. A scroll gas compressor as set forth in claim 4, wherein said member covering the inner wall of said low pressure chamber partitions the inside thereof into a gas-liquid separation space or a storage space for said intake fluid and a passage for said intake gas.

6. A scroll gas compressor as set forth in claim 1, wherein said fixed scroll member comprises a fixed scroll forming together with said whirling scroll said compression chamber and a liner, said liner being press-fitted and fixed to an outer peripheral portion of said panelboard of said fixed scroll and formed in a cylinder with a thin wall, the material of which is the same as that of said container, and the outer peripheral portion of said liner and said container being welded to be sealed and fixed with each other.

7. A scroll gas compressor as set forth in claim 6, wherein said fixed scroll is comprised of a substance that is larger in thermal expansion coefficient than those of said liner and said container.

8. A scroll gas compressor as set forth in claim 7, wherein said high pressure chamber is disposed at the upper portion of said container and said low pressure chamber is disposed at the lower portion of said container.

9. A scroll gas compressor as set forth in claim 7, wherein a diameter of the outer peripheral portion at the low pressure chamber side of said fixed scroll is made smaller than that at the high pressure side thereof, so that said liner is press-fitted into the outer peripheral portion at the low pressure chamber side.

10. A scroll gas compressor as set forth in claim 6, wherein a diameter of the outer peripheral portion at the low pressure chamber side of said fixed scroll is made smaller than that at the high pressure side thereof, so that said liner is press-fitted into the outer peripheral portion at the low pressure chamber side.

11. A scroll gas compressor as set forth in claim 10, wherein said high pressure chamber is disposed at the upper portion of said container and said low pressure chamber is disposed at the lower portion of said container.

12. A scroll gas compressor as set forth in claim 1, wherein the body frame member supporting a drive shaft of said scroll compression mechanism and fixed to said fixed scroll member is fixed to said container.

13. A scroll gas compressor as set forth in claim 12, wherein said body frame member comprises at the outermost periphery thereof said liner of a cylinder with a thin wall, the material of which is the same as that of said container, the outer periphery of said liner being welded to be fixed to said enclosed container.

* * * * *